US008584733B2

(12) United States Patent
D'Arcy et al.

(10) Patent No.: US 8,584,733 B2
(45) Date of Patent: Nov. 19, 2013

(54) DYNAMIC PURGE SYSTEM FOR A HEAT RECOVERY WHEEL

(75) Inventors: Marcus James D'Arcy, Tampa, FL (US); Krister Nils Eriksson, Tampa, FL (US)

(73) Assignee: Thermotech Enterprises, Inc., Oldsmar, FL (US)

( * ) Notice: Subject to any disclaimer, the term of this patent is extended or adjusted under 35 U.S.C. 154(b) by 1002 days.

(21) Appl. No.: 12/642,921

(22) Filed: Dec. 21, 2009

(65) Prior Publication Data

US 2010/0200068 A1 Aug. 12, 2010

Related U.S. Application Data

(60) Provisional application No. 61/150,344, filed on Feb. 6, 2009.

(51) Int. Cl.
*F23L 15/02* (2006.01)

(52) U.S. Cl.
USPC ..... 165/9; 165/8

(58) Field of Classification Search
USPC ..... 165/8, 9; 277/352, 630, 637, 929, 358, 277/408
See application file for complete search history.

(56) References Cited

U.S. PATENT DOCUMENTS 3,695,250 A * 10/1972 Rohrs et al. ..... 126/110 R
4,014,380 A * 3/1977 Rush et al. ..... 165/236
4,134,743 A * 1/1979 Macriss et al. ..... 95/113
4,967,726 A * 11/1990 Finch ..... 126/99 R
5,002,116 A * 3/1991 Hoagland et al. ..... 165/9
5,526,651 A * 6/1996 Worek et al. ..... 62/271
5,542,259 A * 8/1996 Worek et al. ..... 62/94
5,562,089 A * 10/1996 Astle, Jr. ..... 126/117
5,826,434 A * 10/1998 Belding et al. ..... 62/90
5,860,284 A * 1/1999 Goland et al. ..... 62/94
5,890,372 A * 4/1999 Belding et al. ..... 62/271
5,937,933 A * 8/1999 Steele et al. ..... 165/10
6,016,710 A * 1/2000 Boles et al. ..... 73/861.42
7,886,986 B2 * 2/2011 Fischer et al. ..... 236/49.3
2010/0200068 A1 * 8/2010 D'Arcy et al. ..... 137/1
2010/0275775 A1 * 11/2010 Griffiths et al. ..... 95/18

* cited by examiner

*Primary Examiner* — Marc Norman
*Assistant Examiner* — Devon Russell
(74) *Attorney, Agent, or Firm* — Allen, Dyer, Doppelt, Milbrath & Gilchrist, P.A.

(57) ABSTRACT

An automatically operable dynamic purge system that is incorporated into a heat recovery wheel that comprises a number of radial seals that direct a controlled area of supply air into the exhaust air stream passing through the heat recovery wheel. Two possible configurations include a single purge and a double purge. For the single purge, one seal is fixed in location on one face of the wheel and a second seal is dynamic and is on the opposite face. For the double purge, two seals are fixed in location on one face of the wheel and a third seal is dynamic and is on the opposite face. In each case the dynamic seal is secured by an automatically operable wiper blade. This wiper blade is attached near the center of the wheel such that it rotates, in turn, allowing the seal to rotate while remaining approximately radial to the wheel.

8 Claims, 30 Drawing Sheets

DYNAMIC PURGE SYSTEM FOR A HEAT RECOVERY WHEEL

RELATED APPLICATION

This application claims the benefit of U.S. Provisional Patent Application Ser. No. 61/150,344 filed Feb. 6, 2009.

FIELD OF THE INVENTION

The invention relates to system and method for controlling heat recovery wheels in building ventilation systems.

BACKGROUND OF THE INVENTION

Heat wheels are used worldwide in buildings where exhausted stale or contaminated air is being exchanged with outside air. The device transfers heat and humidity between the exhaust and supply air streams by rotating between the two adjacent air streams. The wheel transfers sensible heat energy as it absorbs energy in one air stream and emits it in the other. Latent heat energy can be transferred by using a desiccant. By transferring this energy the wheel reduces the work required by an air conditioning unit, providing the owner with a cost saving. There are companies producing this product in Sweden, Japan, India and the USA.

To minimize cross flow of the higher pressure supply air to the lower pressure exhaust air, seals are used. These comprise seals around the circumference (circumference seal 64) of the wheel and also across the diameter (diameter fixed seal 62), where the air flows are separated as depicted in FIG. 1, which depicts seals around the wheel 14 to stop flow between air streams.

The wheel 14 is fluted so that air may flow through it. In order to prevent carry-over of contaminants from the exhaust air to the supply air, a purge system is normally installed. FIGS. 2 and 3 schematically show a fixed single purge that offers protection from contaminants being carried within the wheel 14 from the exhaust flow to the supply flow. The common solution is to angularly displace one of the radial seals 52 relative to a fixed seal 62 so that there is a controlled area where the higher pressure supply air opposes the lower pressure contaminated exhaust air. This results in the supply air pushing the exhaust air back through the wheel, before that section of the wheel 14 rotates into the supply air stream. A purge system is important because it prevents contaminants being recirculated into the conditioned air. Laboratories have specifically stringent requirements in this area.

A double purge may also be used, where the purge air flow passes through the wheel twice and provides improved scrubbing for contaminants. FIGS. 4 and 5 schematically depict a fixed double purge that provides improved performance as purge air passes through the wheel flutes twice by means of two fixed displaced (spaced-apart) seals 56 and a seal 62 in its original position.

The angular displacement required for the purge system is defined by the rotational speed of the wheel 14 and the speed at which the air travels through the wheel 14. The latter is further defined by the media characteristics and the pressure difference between supply and exhaust air streams. The higher the pressure difference the lower the purge angle can be.

To date, purge systems have been fixed, that is, they do not automatically move. The user is able to adjust the purge angle, but it is impractical to adjust the often bolted arrangement regularly as air flow conditions change. The fixed angle restricts system performance. For safety reasons, the purge angle should be designed for the lower operating pressures. But when air flows are higher, the purge is no longer at optimum position and excessive supply air is allowed to short circuit back into the exhaust air flow without flowing through the building first. This wastes energy and reduces cost savings to the customer.

U.S. Patent Application Publication 2008/0108295 to Fischer et al. discloses one approach to attempt to address this problem by varying the rotational speed of the wheel, slowing the speed as pressure difference reduces. This is not an optimal solution as thermodynamic performance is negatively affected.

What is needed is a product that provides an automatically operating and dynamically moving purge system which adapts to prevailing air flow conditions and provides the optimal solution at all times. By solving this problem using an automatically operating and dynamically moving purge system, the customer will have reduced air conditioning costs because the wheel will transfer heat more effectively under varying conditions and there is less cross flow from supply air to exhaust air, so loads on the air conditioning fans can be reduced.

SUMMARY OF THE INVENTION

Generally, the invention is an automatic operable and dynamic purge system utilizing either a single or a double purge system that is incorporated into a heat wheel such as a Thermowheel™ heat wheel made by Thermotech Enterprises, Inc. of Tampa, Fla. For an automatically operable dynamic single purge, the system comprises two radial seals. The first seal is fixed in location on one face of the wheel and the second seal is dynamic and is on the opposite face. For the dynamic double purge, the system comprises three radial seals. Two seals are fixed in location on one face of the wheel and the third seal is dynamic and is on the opposite face. In both instances the purge directs a controlled area of supply air into the exhaust air stream passing through the heat recovery wheel. The latter configuration is called a double purge because this purge air must travel through the wheel twice, enabling improved purge performance.

In both cases the dynamic seal is secured by an automatic operable wiper blade. This wiper blade is pin jointed (pivotally attached) near the center of the wheel so that it rotates, in turn, allowing the seal to rotate whilst remaining approximately radial to the wheel. The automatic wiper blade's position is defined by a control unit which implements mechanical movement.

Again to summarize, the invention is an automatic operable, dynamic purge system for a heat recovery wheel comprising:

a heat recovery wheel assembly having one or two fixed seals and a dynamically movable radial seal, said one or two fixed seals and said dynamically movable radial seal being configured for directing a controlled supply of air into an exhaust air stream passing through a heat recovery wheel of said assembly, wherein said one or two fixed seals are on one face of said heat recovery wheel and said dynamically movable radial seal and is located on an opposite face of said heat wheel recovery;

wherein when said heat recovery wheel includes said one fixed seal and said dynamically movable radial seal, said seals are located to create a single purge so that purged air travels through said wheel once, and wherein when said heat recovery wheel includes said two fixed seals and said dynamically movable radial seal, said seals are located to create a double purge so that purged air travels through said wheel twice, said dynamically movable radial seal being secured by an automatically operable rotatable wiper blade, wherein as said wiper blade rotates, said dynamically movable radial seal rotates while remaining approximately radial to said heat recovery wheel.

The system further comprises means for altering an effective angle of said single or double purge by moving said wiper blade to a desired optimal position based on time varying air flow conditions and predetermined input data calculated by a control system, wherein said means for altering said effective angle of said single or double purge by moving said wiper blade to said desired optimal position based on said predetermined input data comprises actuator means in mechanical communication with said wiper blade, and wherein said predetermined input data includes one of or any combination of:

data related to an air velocity at an exit side of a first pass through a purge section;

data related to first air velocity at exit side of said first pass through said purge section and data related to a second air velocity at a second exit of a second pass through said purge section;

data related to a first air pressure at said exit side of said first pass through said purge section, and data related to a second air pressure at an entry side before a supply air enters said purge section;

data related to a first air pressure at said exit side of said first pass through said purge section, data related to a second air pressure at a second exit of a second pass through said purge section and data related to a third air pressure at an entry side before a supply air enters said purge section; and data related to temperature at an exit side of a first pass through said purge section.

The invention further includes a method for directing a controlled supply of air into an exhaust air stream passing through a heat recovery wheel of a heat recovery wheel assembly, the method comprising:

providing a heat recovery wheel assembly having one or two fixed seals and a dynamically movable radial seal, said one or two fixed seals and said dynamically movable radial seal being configured for directing a controlled supply of air into an exhaust air stream passing through a heat recovery wheel of said assembly, wherein said one or two fixed seals are on one face of said heat recovery wheel and said dynamically movable radial seal and is located on an opposite face of said heat recovery wheel, wherein when said heat recovery wheel includes said one fixed seal and said dynamically movable radial seal, said seals are located to create a single purge so that purged air travels through said wheel once, and wherein when said heat recovery wheel includes said two fixed seals and said dynamically movable radial seal, said seals are located to create a double purge so that purged air travels through said wheel twice, wherein said dynamically movable radial seal is secured by a rotatable wiper blade, wherein as said wiper blade rotates, said dynamically movable radial seal rotates while remaining approximately radial to said heat recovery wheel;

providing means for altering an effective angle of said single or double purge by automatically moving said wiper blade to a desired optimal position based on time varying air flow conditions and predetermined input data calculated by a control system; and directing a controlled supply of air into an exhaust air stream passing through said heat recovery wheel of said heat recovery wheel assembly by moving said wiper blade to said desired optimal position based on said predetermined input data calculated by said control system, wherein said predetermined input data includes one of or any combination of:

data related to an air velocity at an exit side of a first pass through a purge section;

data related to first air velocity at said exit side of said first pass through said purge section and data related to a second air velocity at a second exit of a second pass through said purge section;

data related to a first air pressure at said exit side of said first pass through said purge section, and data related to a second air pressure at an entry side before a supply air enters said purge section;

data related to a first air pressure at said exit side of said first pass through said purge section, data related to a second air pressure at a second exit of a second pass through said purge section and data related to a third air pressure at an entry side before a supply air enters said purge section; and data related to temperature at an exit side of a first pass through said purge section.

The means for altering said effective angle of said single or double purge by moving said wiper blade to said desired optimal position based on said predetermined input data comprises actuator means in mechanical communication with said wiper blade.

BRIEF DESCRIPTION OF THE DRAWINGS

In the accompanying drawings.

DETAIL DESCRIPTION OF THE INVENTION

Figure 1:
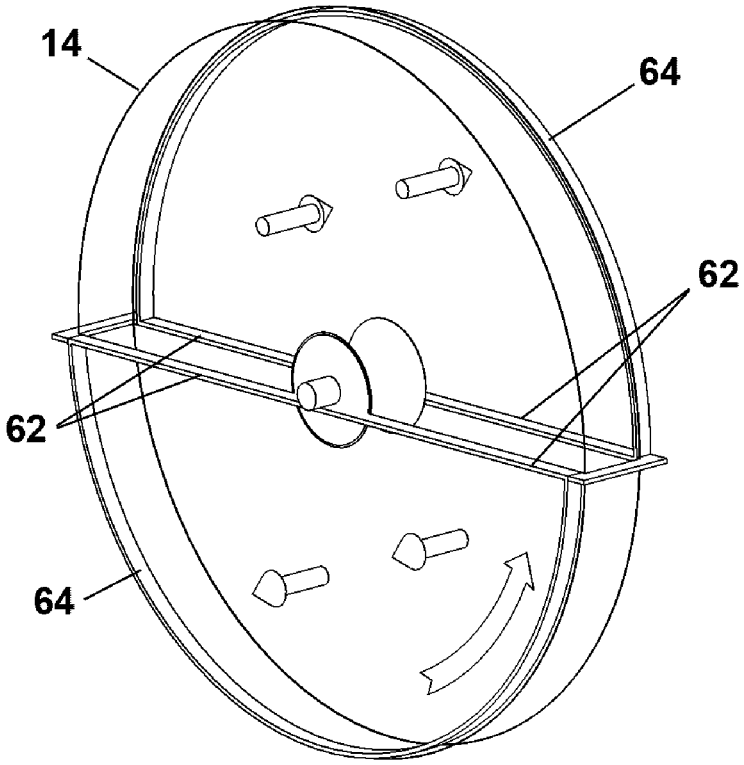
Prior Art Fig. 1
FIG. 1 is a schematic depiction of seals on a prior art heat recovery wheel 14 that stop cross flow between exhaust and supply air streams.
Figure 2:
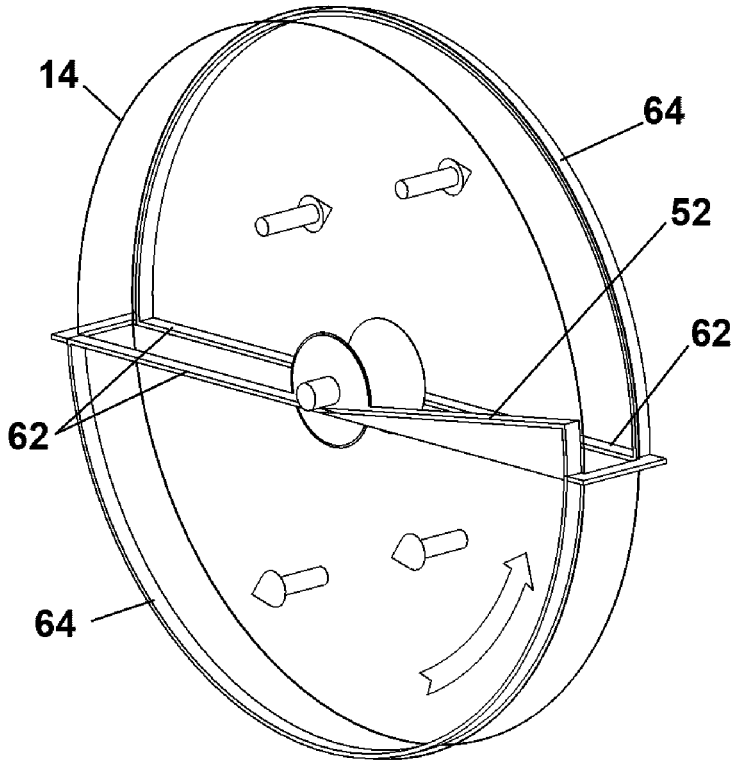
Prior Art Fig. 2
FIG. 2 is a schematic depiction of a fixed single purge system on a prior art heat recovery wheel, comprising radial seals and fixed radial seal that offers protection from contaminants being carried within the wheel from the exhaust flow to the supply flow.
Figure 3:
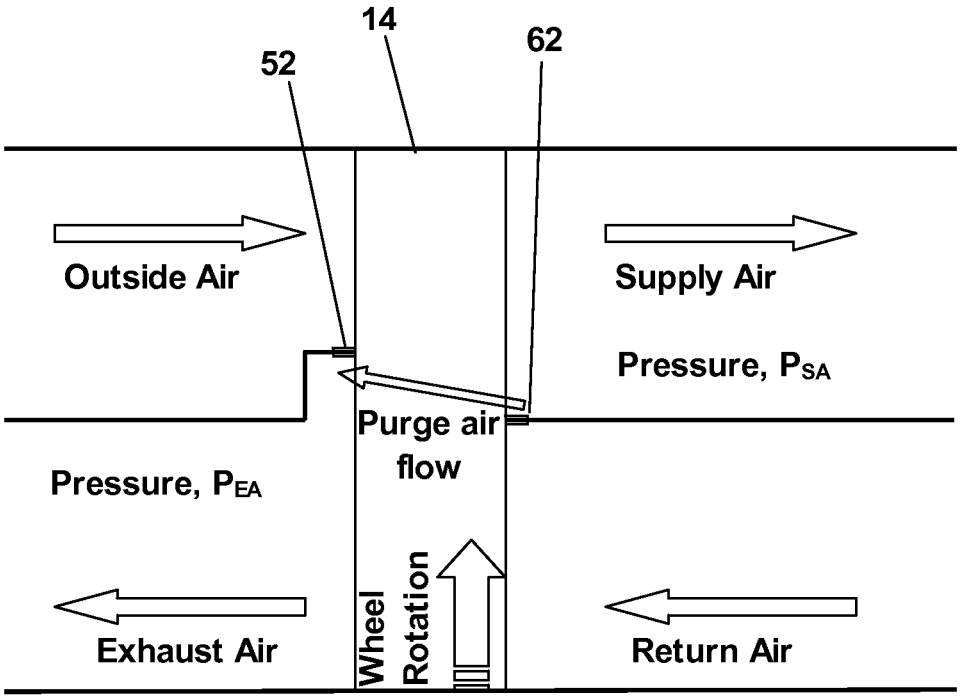
Prior Art Fig. 3
FIG. 3 is another schematic depiction related to FIG. 2 of a fixed single purge system on a prior art heat recovery wheel that offers protection from contaminants being carried within the wheel from the exhaust flow to the supply flow.
Figure 4:
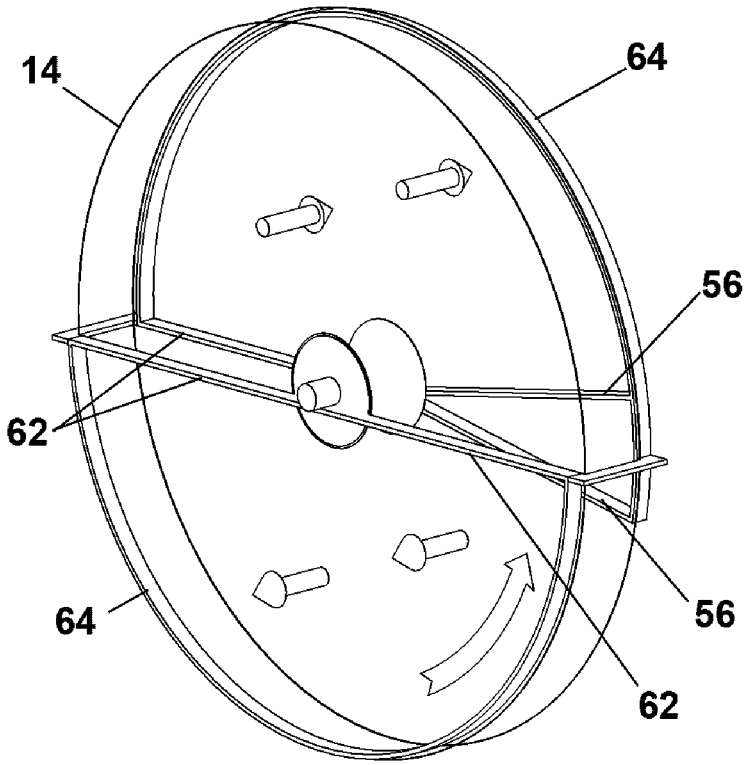
Prior Art Fig. 4
FIG. 4 is a schematic depiction of a prior art fixed double purge, comprising two fixed radial seals that provides improved performance as purge air passes through the wheel twice.
Figure 5:
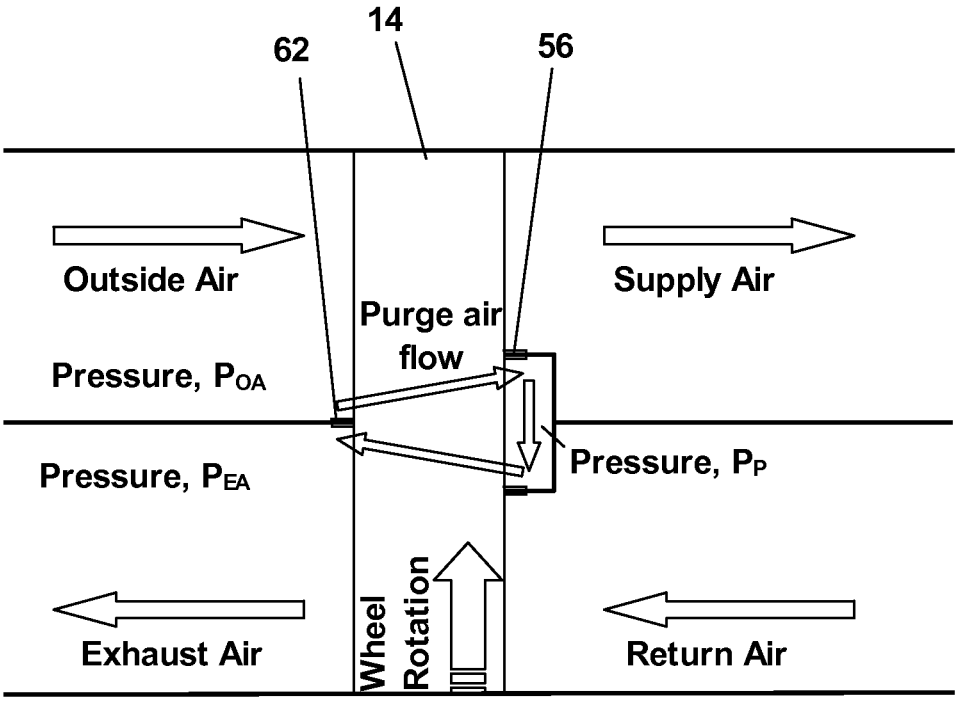
Prior Art Fig. 5
FIG. 5 is another schematic depiction related to FIG. 4 of a prior art fixed double purge that provides improved performance as purge air passes through the wheel twice.
Figure 6:
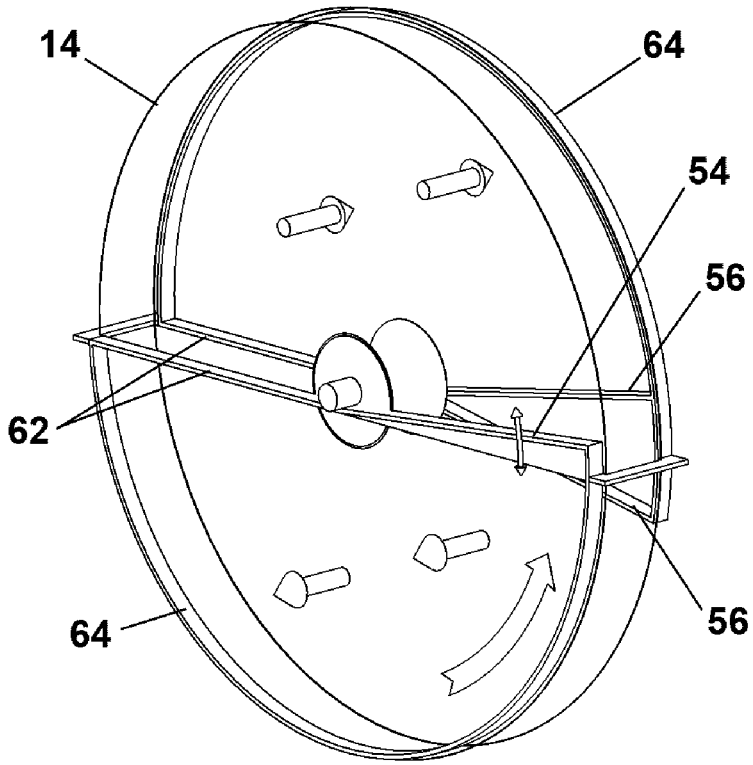
FIG. 6 shows the 3-Dimensional layout of the present invention in the double purge configuration, which uses a dynamic seal to alter the effective angle of a double purge thus providing a dynamic double purge that responds to varying flow conditions.

Referring now to the drawings, FIGS. 6-30 disclose varying embodiments of the present invention, which generally is a dynamic purge system that is incorporated into a heat recovery wheel. The system may be incorporated into the heat recovery wheel in a single purge arrangement or a double purge arrangement.

The single purge system comprises two radial seals 52,54 that direct a controlled area of supply air into the exhaust air stream passing through the heat recovery wheel. One seal 52 is fixed in location on one face of the wheel 14 and the second seal is dynamic 54 and is on the opposite face. The configuration is called a single purge because this purge air must travel through the wheel only once.

The dynamic seal 54 is secured by an automatic wiper blade 12. This wiper blade is pin jointed (or pivotally attached at 24) near the center of the wheel 14 so that it rotates, in turn, allowing the seal to rotate whilst remaining approximately radial to the wheel. The automatic wiper blade's position is defined by a control unit 16 which implements mechanical movement by controlling the actuator 22.

Figure 9:
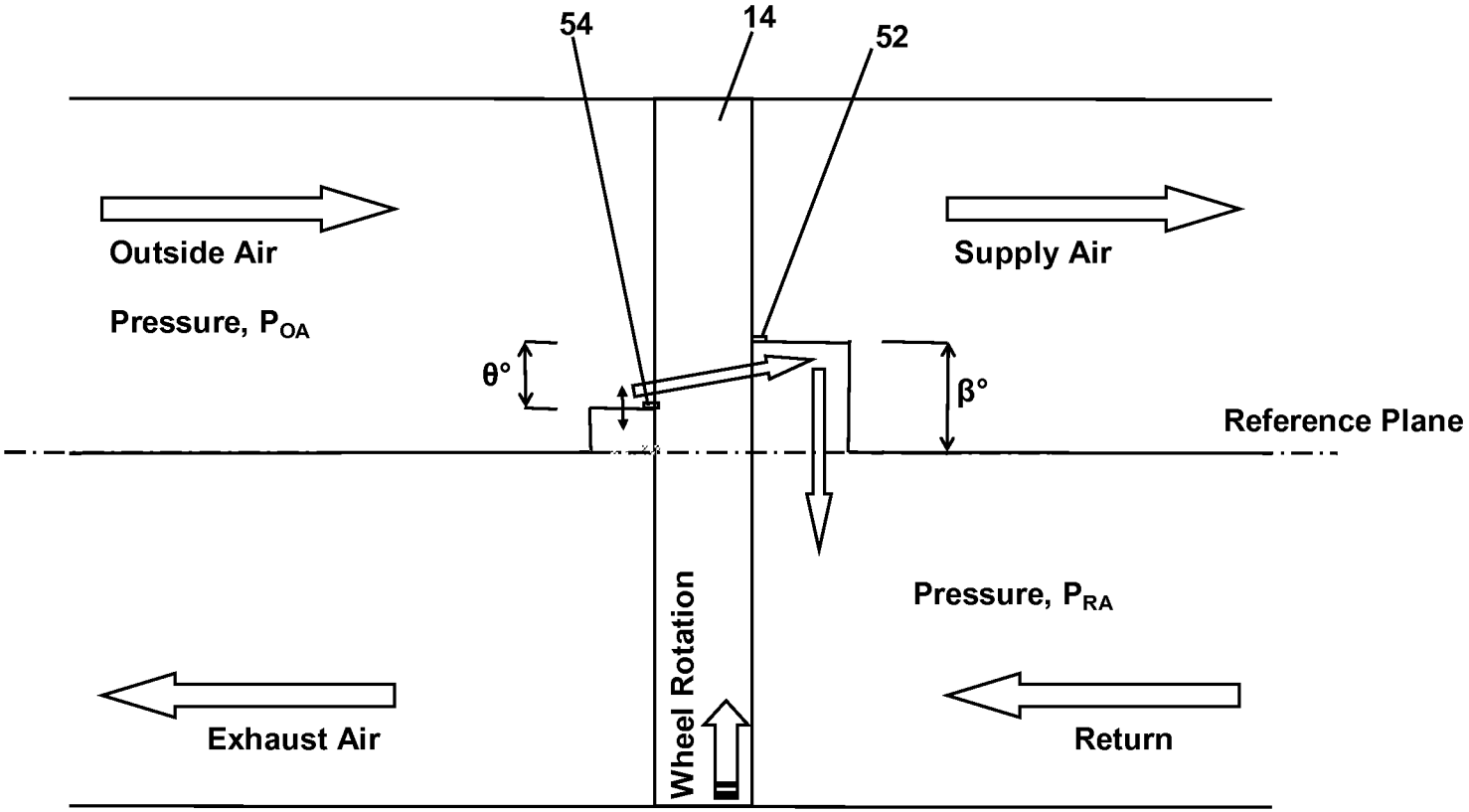
FIG. 9 shows the schematic layout of the present invention in the single purge configuration (see FIG. 8) which uses a dynamic seal and two fixed seal to alter the effective angle of a single purge thus providing a dynamic single purge that responds to varying flow conditions.
Figure 10:
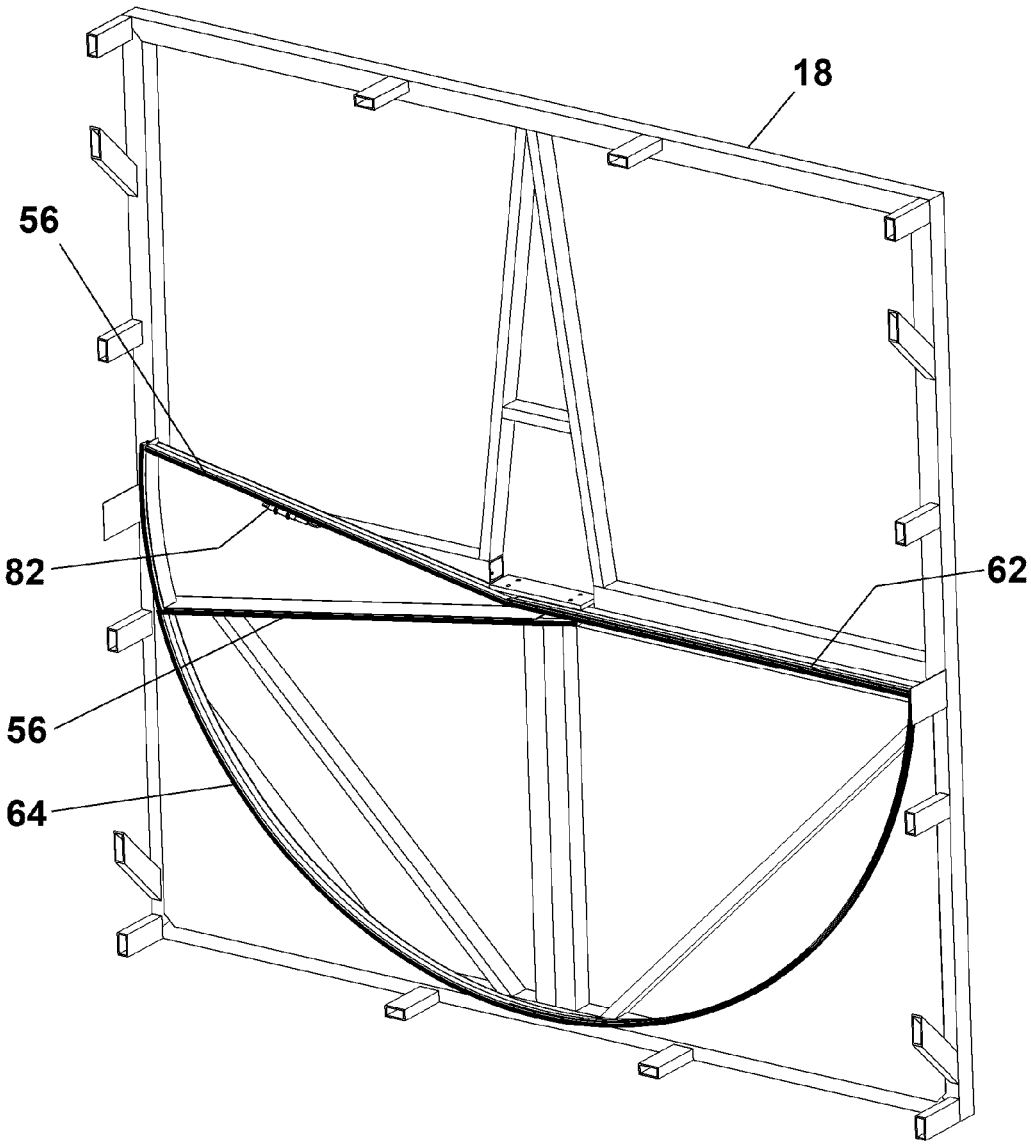
FIG. 10 depicts a rear view section taken from inside a Thermowheel™ casing, adapted with two fixed radial seals for the dynamic double purge.
Figure 11:
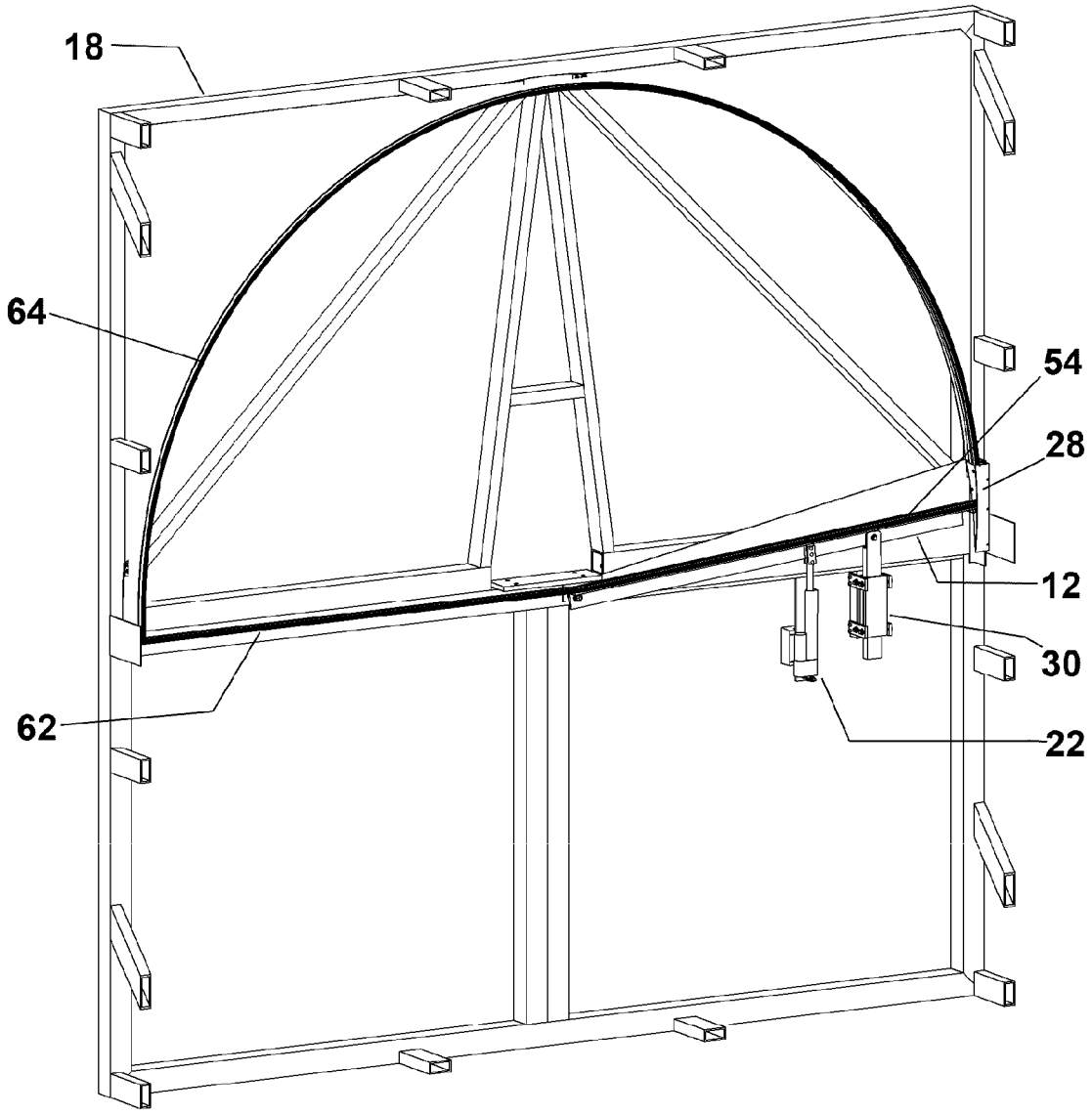
FIG. 11 depicts a front view section taken from inside a Thermowheel™ casing, adapted with mounts and brackets (see FIG. 17) and the dynamic wiper blade of the present invention mounted; this arrangement applies to both single purge and double purge configurations.
Figure 12:
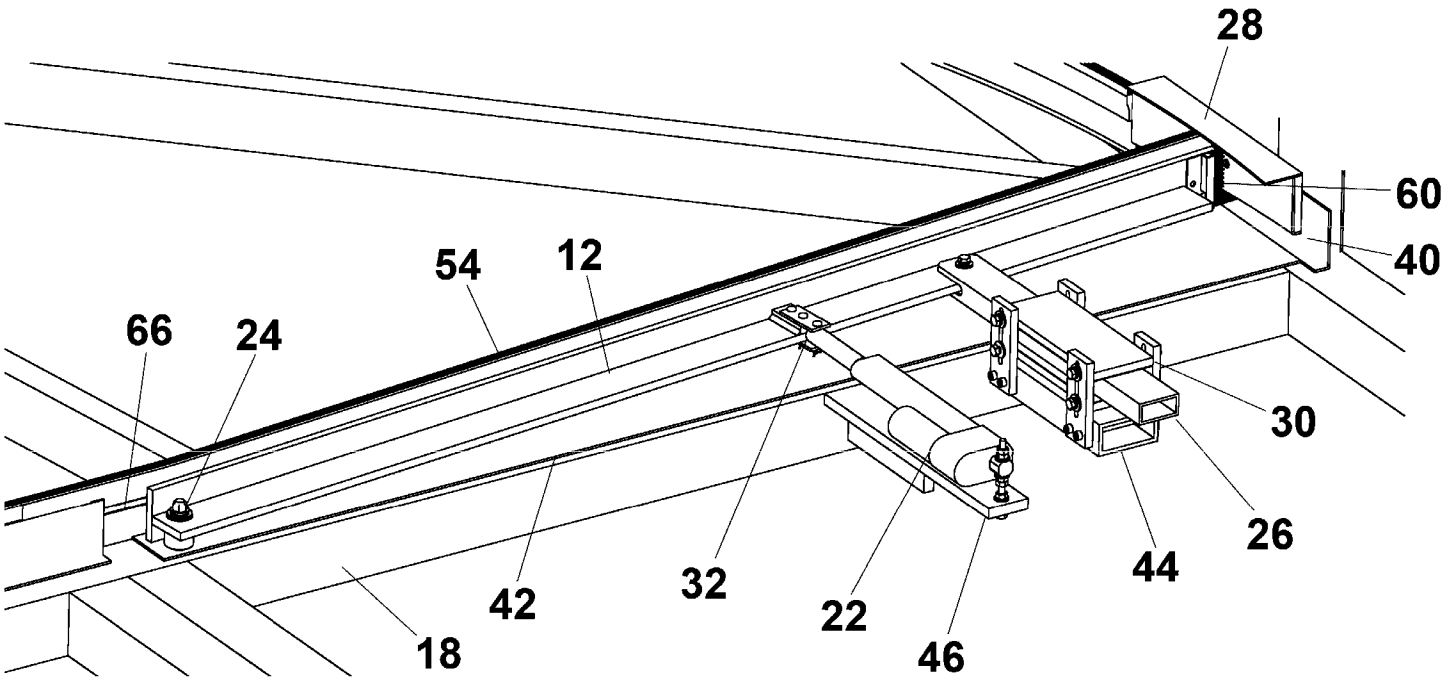
FIG. 12 is an example of the dynamic seal in either the single purge or double purge configuration, which is secured by a wiper blade that is pin jointed near the center of the wheel so that it rotates, in turn, allowing the seal to rotate whilst remaining approximately radial to the wheel.

FIG. 9 depicts a reference plane, defined as the plane where the supply and exhaust air flows are separated. In this example, the fixed seal 52 is arranged at angle β to this plane. The dynamic seal 54 is able to move from a minimum angle to this plane, $\theta_{min}$ towards a predefined maximum angle to the plane, $\theta_{max}$. When the dynamic seal 54 is located at $\theta_{max}$ the area between it and the fixed seal 52 is at a minimum and the purge is arranged for the highest designed air flow velocity. When the dynamic seal 54 is located at $\theta_{min}$ the area between it and the fixed seal 52 is at a maximum and the purge is arranged for the lowest designed air flow velocity. The wiper blade 12 is not normally able to move above $\theta_{max}$, since this means the purge area has reduced below a safe angle for the designed conditions.

The double purge system comprises three radial seals (radial seal 54 and two spaced-apart or displaced radial seals 56) that direct a controlled area of supply air into the exhaust air stream passing through the heat recovery wheel. Two seals 56 are fixed in location on one face of the wheel 14 and the third seal 54 is dynamic and is on the opposite face. The configuration is called a double purge because this purge air must travel through the wheel 14 twice, enabling improved purge performance.

The third dynamic seal is secured by an automatic operable wiper blade 12. This wiper blade 12 is pin jointed at 24 near the center of the wheel 14 so that it rotates, in turn, allowing the seal 54 to rotate whilst remaining approximately radial to the wheel 14. The automatic operable wiper blade's position is defined by a control unit 16 which implements mechanical movement.

Figure 7:
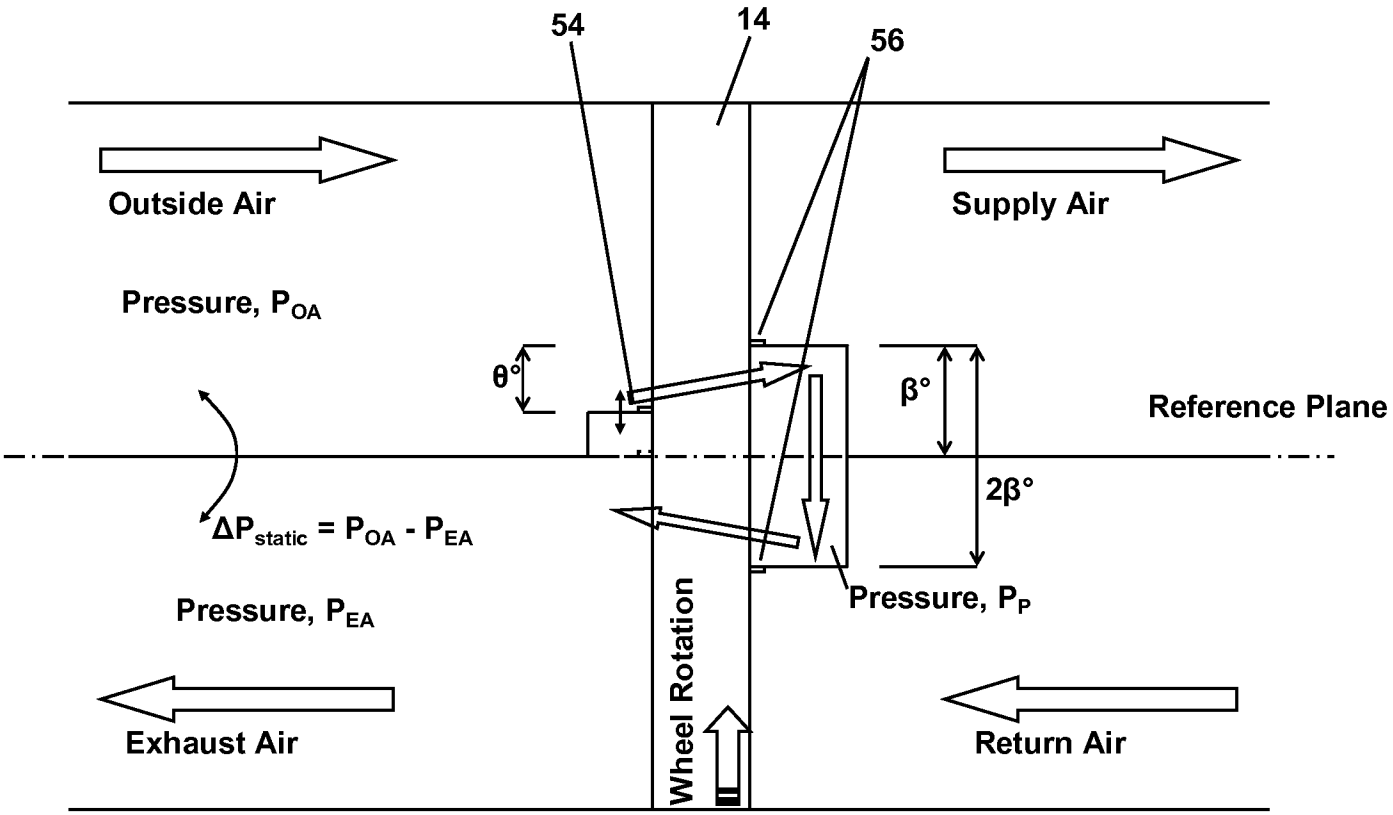
FIG. 7 shows the schematic layout of the present invention in the double purge configuration (see FIG. 6) which uses a dynamic seal and two fixed seals to alter the effective angle of a double purge thus providing a dynamic double purge that responds to varying flow conditions.
Figure 8:
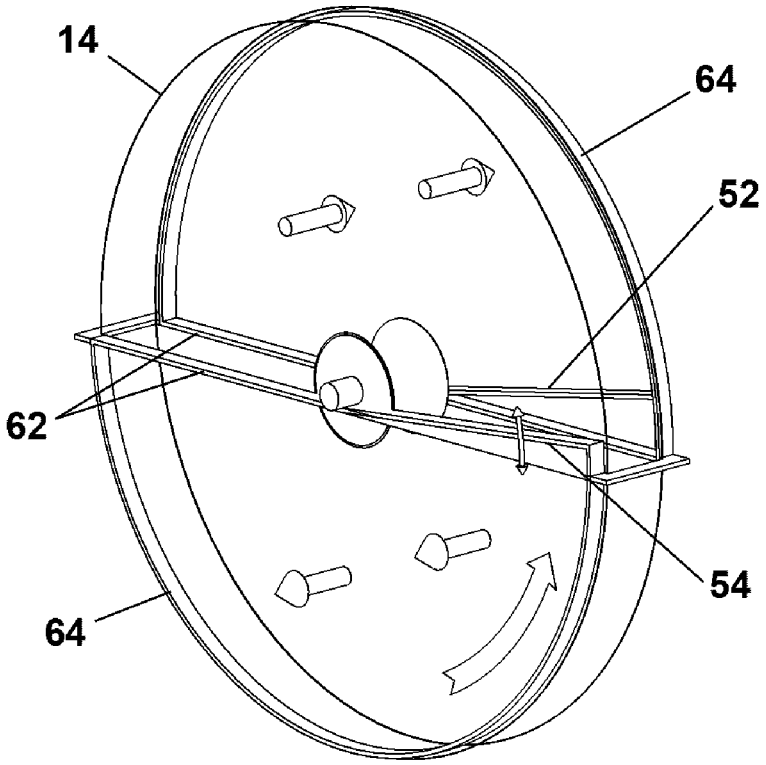
FIG. 8 shows the 3-dimensional layout of the present invention in the single purge configuration, which uses a dynamic seal and fixed seal to alter the effective angle of a single purge thus providing a dynamic single purge that responds to varying flow conditions.

FIG. 7 depicts a reference plane, defined as the plane where the supply and exhaust air flows are separated. The two fixed seals 56 are arranged in a predetermined position with defined, equal angles between them and the reference plane (i.e. ±β° to the reference plane). The dynamic seal 54 is able to move from 0° to this plane (i.e. when θ=β°) towards (but not equal to) the fixed seal on the supply air side (i.e. θ→0). When the dynamic seal 54 is located at 0°, the area between it and the supply air seal 56 is at a maximum and the purge is arranged for the lowest designed air flow velocity. As the wiper blade 12 moves towards the seal 56 on the supply air this area reduces and the arrangement is optimized for higher air flow velocities. The wiper blade 12 is not able to align with the fixed seal 56 opposite, since this means the purge area has reduced to zero and no purging is taking place.

Example of Mechanical Arrangement

In the drawings, it is assumed for purposes of example only that the invention is being incorporated into a Thermowheel™ case 18. The fixed seal(s) 52,56 is/are attached to the case using established processes for that product.

In one example of mechanically incorporating the present inventive dynamic system, the system has the following main sub-assemblies:

Wiper Blade 12 (see FIG. 13): The wiper blade 12 pivots around a pin joint 24 close to the center of the wheel 14 and is an aluminum section that enables mounting of seals 54,58, the pin joint 24, actuator 22 and stiffening devices 26,30 in their correct orientation.

Seals attached to wiper blade (see FIG. 12): The dynamic seal 54 is attached to the wiper blade 12 preferably by means of screws. The radial seal is adjustable 54, so that its position can be varied relative to the wiper blade 12. This enables the seal to be closely aligned to the wheel 14, with minimum gap.

Figure 13:
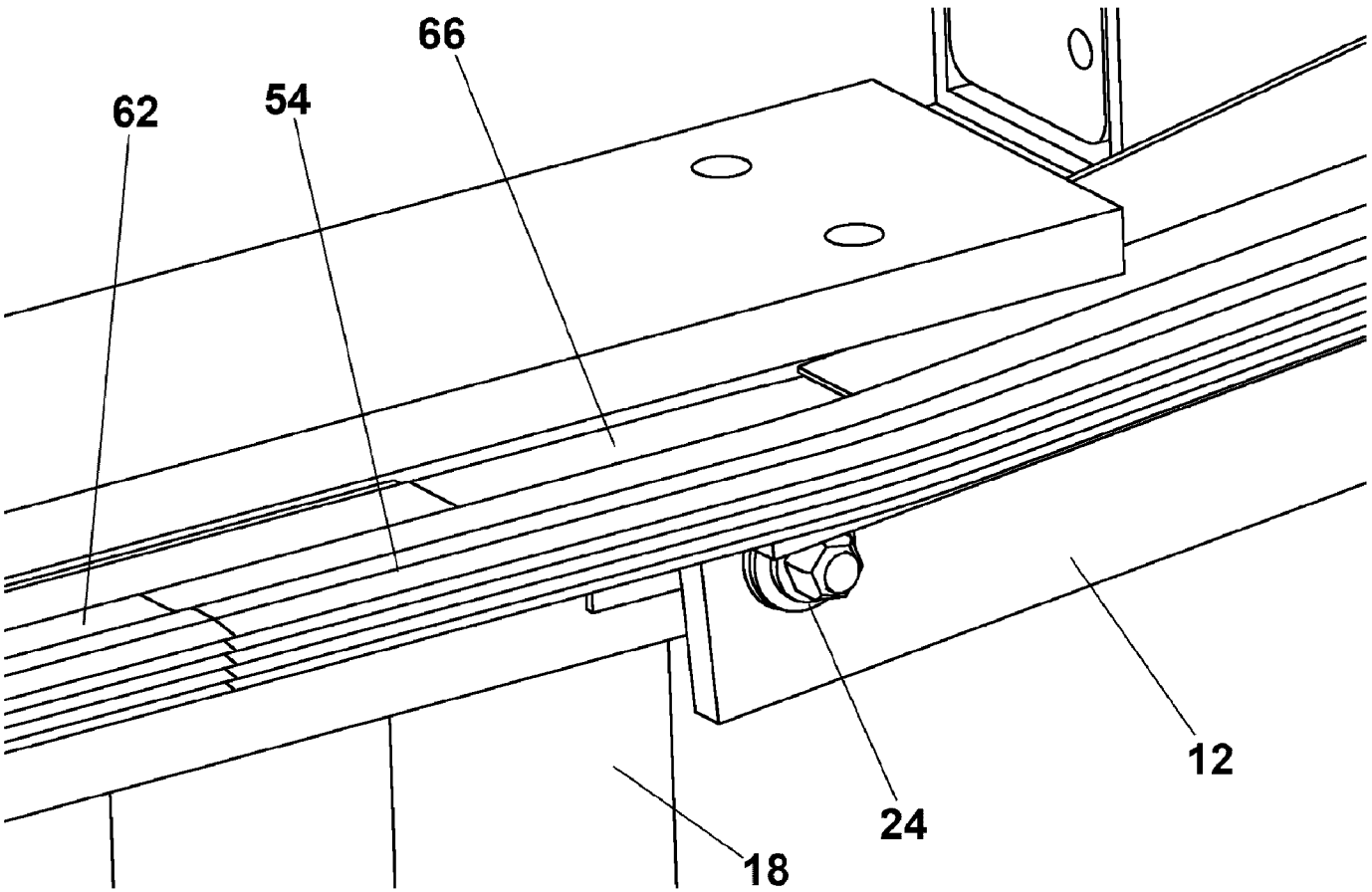
FIG. 13 is an example of the seal showing its continuity near the pin joint of FIG. 12.
Figure 14:
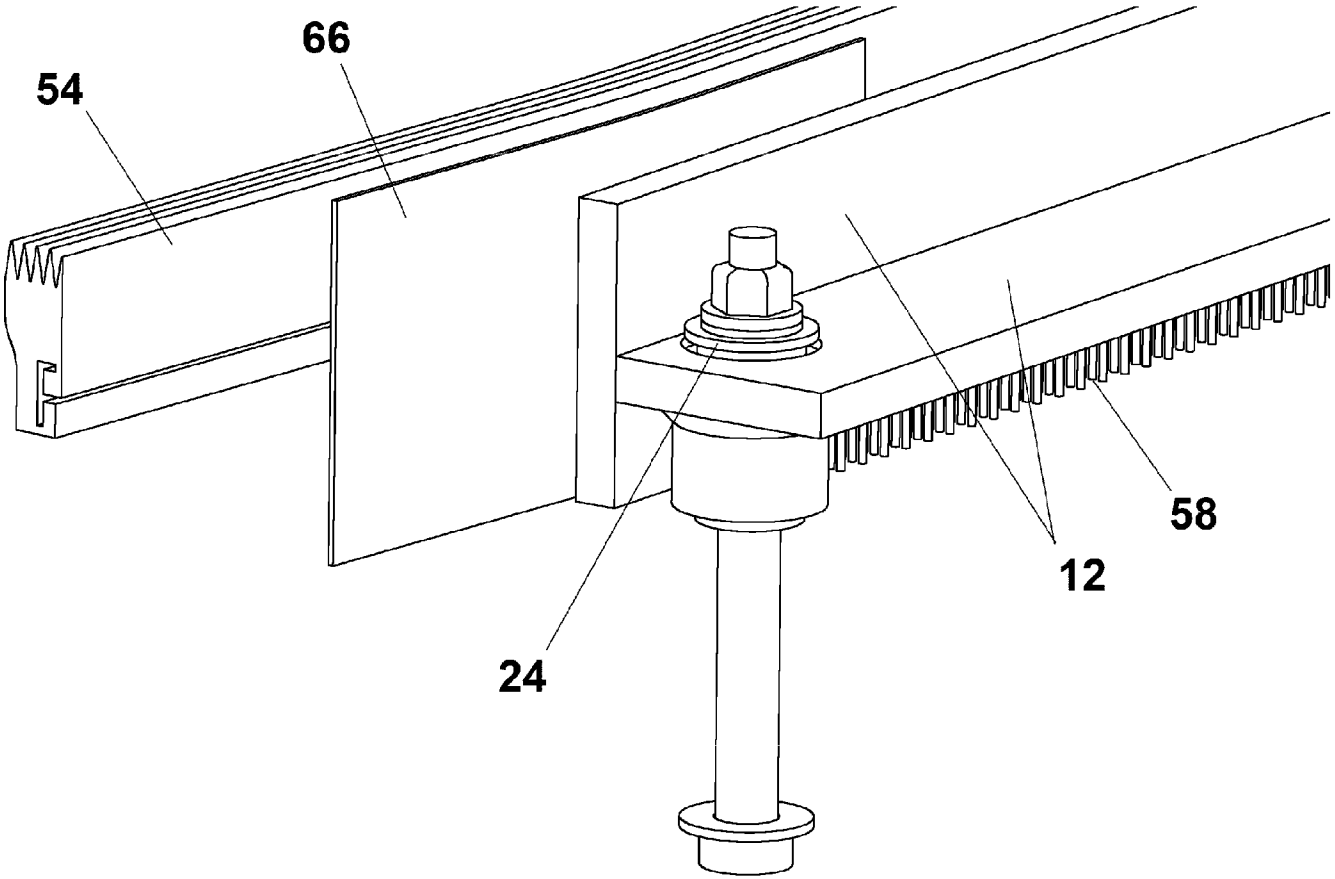
FIG. 14 is a depiction of one example of providing a pin joint.
Figure 15:
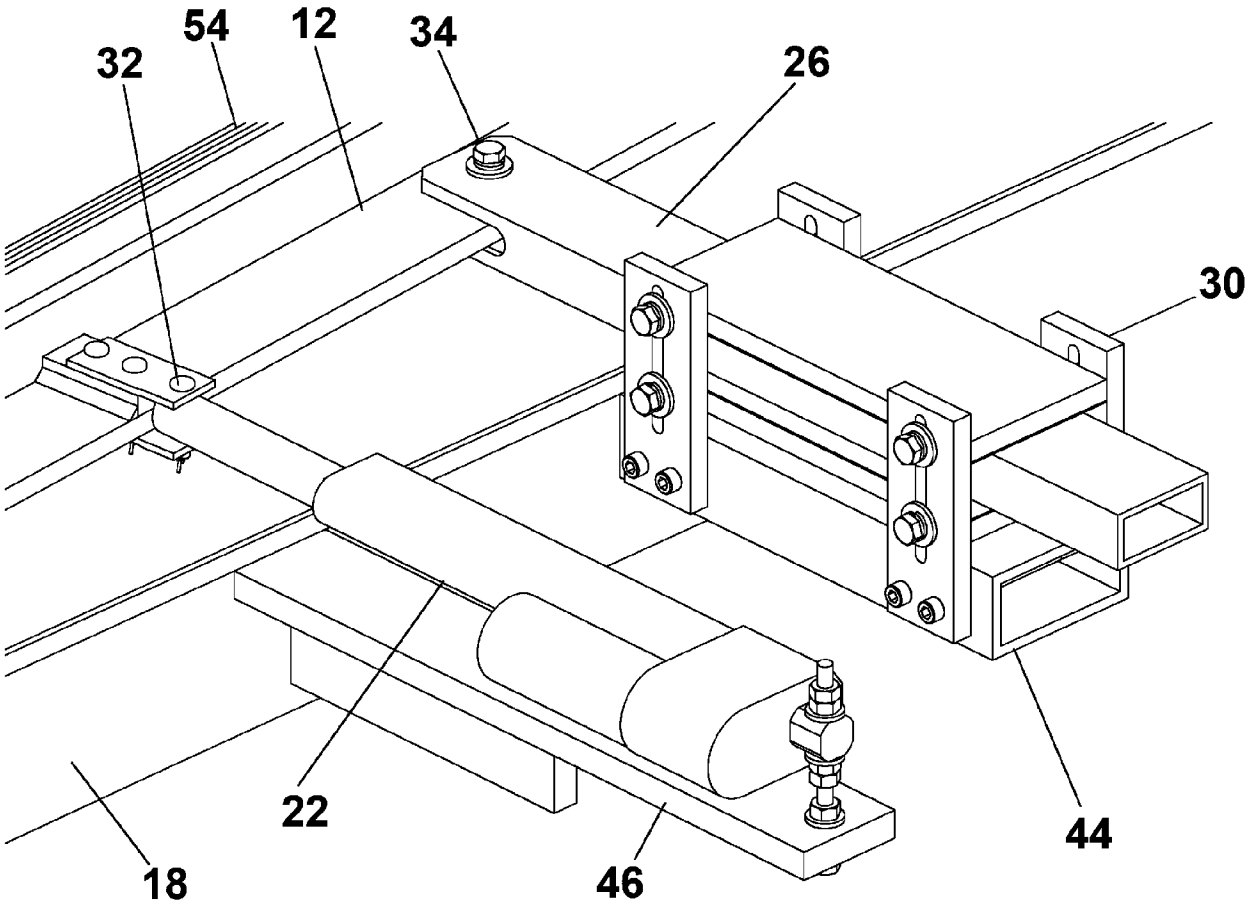
FIG. 15 is a conceptual depiction of one example of providing an actuator arrangement and providing a torsional stiffener arrangement, maintaining planar motion only for both the stiffener arm and the wiper blade, as depicted in FIG. 12.
Figure 16:
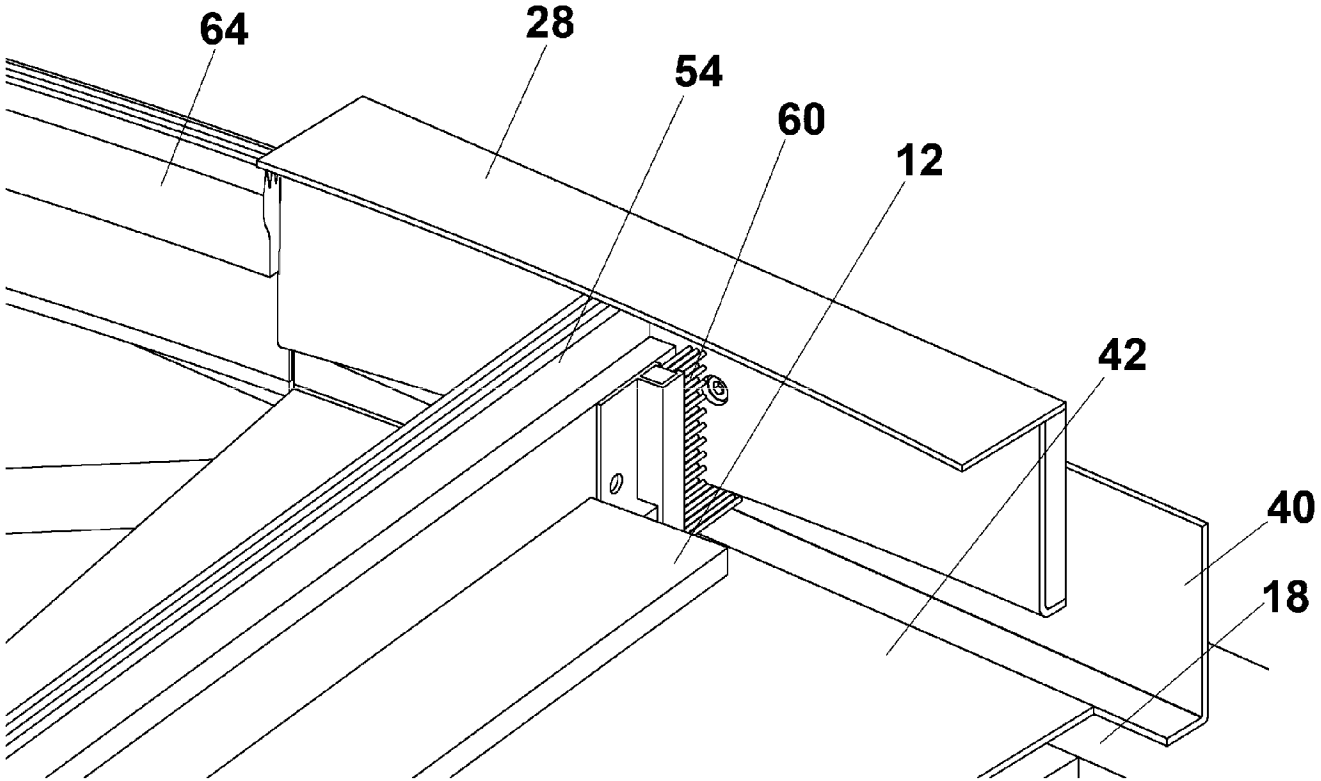
FIG. 16 is a depiction of an undercut seal.
Figure 17:
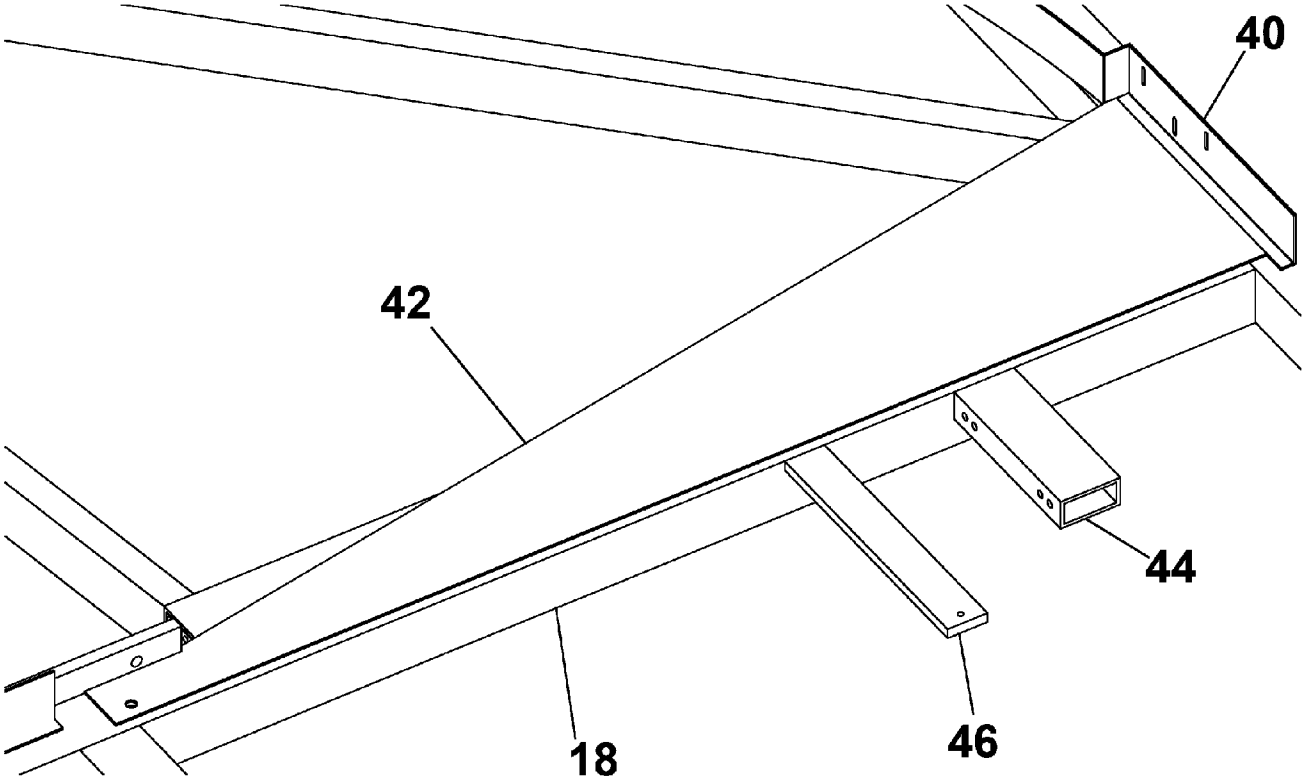
FIG. 17 depicts an example of additional metal work required to mount the dynamic purge system.

Near the center of the wheel 14, the rubber seal 54 butts against a fixed seal 62 (see FIG. 13). It remains flexible over a short span to enable movement of the wiper blade 12. Gaps are eliminated by a flexible seal 66 that replaces the missing metallic structure.

Pin Joint 24 (see FIG. 14 and FIG. 22): The pin joint 24 is in effect an axis of rotation 24 of the wiper blade 12 restricts movement of the wiper blade 12 normal to the face of the wheel 14. The bolted sub-assembly can be disassembled through life for convenient maintenance or replacement and comprises a shoulder bolt 24*a*, bronze bearings 24*b*, washers and a locknut Actuator 22 (see FIG. 15 and FIG. 22): A linear actuator 22 is attached to a mount on the Thermowheel™ case 46 and a pin jointed interface on the wiper blade 12. This enables automatically operable controlled movement of the wiper blade 12 relative to the structure 18. The pin jointed interface 32 comprises brackets and fasteners for easy disassembly and maintenance.

Torsional Stiffener 30 (see FIG. 15 and FIG. 22): A stiffening mechanism is used to maintain straightness in the wiper blade 12. This opposes twisting forces created by a pressure difference across the seal 54. A straight bar 26 is secured between two pairs of adjustable slides 30*a* which are fastened to the columns 30*b* and lubricated with bearing material. The bar 26 may only move by sliding in this plane as defined by the adjustable slides 30*a*. A pin joint 34 links the straight bar 26 to the wiper blade 12 and restricts its movement in the same plane, and comprises bolt 34*a*, bronze bearings 34*b*, washers and a nut. The sub-assembly is adjustable for fine adjustment post-installation by repositioning the slides 30*a* relative to the columns 30*b*.

Undercut Seal 28 (see FIG. 16): The wiper blade 12 is near, but not on, the wheel's rotational axis. To maintain a good seal at the end of the blade relative to the wheel's circumference an undercut seal 28 is designed. Its geometry is arranged so the circumferential seal 64 terminates at the dynamic purge and is replaced by a geometry that enables a continued circumferential seal, whilst with a curved undercut that centers on the axis of rotation 24 for the wiper blade 12. This enables the blade 12 to maintain close proximity to the seal 28. A brush seal 60 is further attached to the wiper blade 12 to maintain a close seal at this interface.

Case Modifications (see FIG. 17): Additional brackets and braces are welded or otherwise attached onto the Thermowheel™ case 18 to enable installation of the wiper assembly and repositioning of fixed seals. These additions comprise a bracket 40 for mounting the undercut seal 28, a flat backplate 42 in the plane of the wiper blade's 12 motion, a mount 44 for the torsional stiffener assembly 30 and a mount 46 for the actuator 22.

Figure 18:
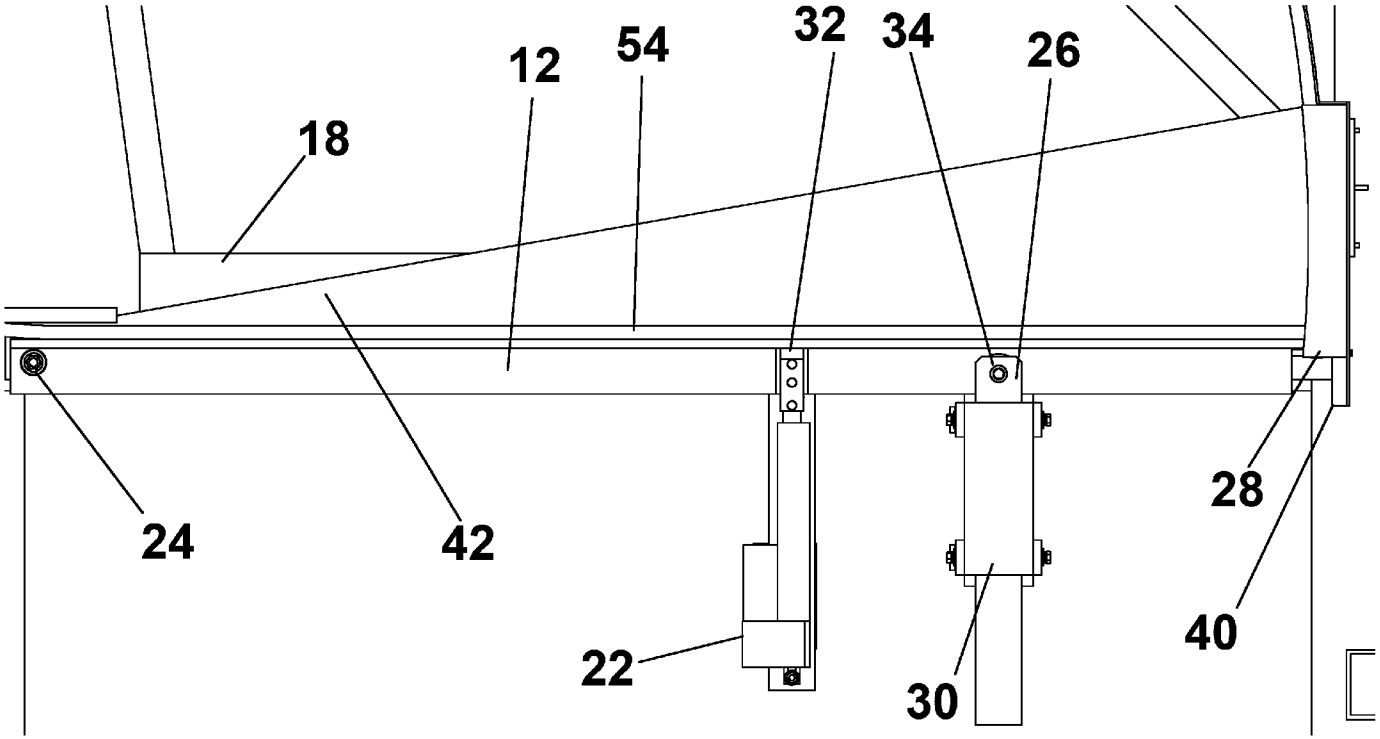
FIG. 18 depicts a graphic representation of the blade at 100% of maximum purge.

FIG. 18 shows the arrangement with angle $\theta=\beta$, representing 100% of maximum purge.

Figure 19:
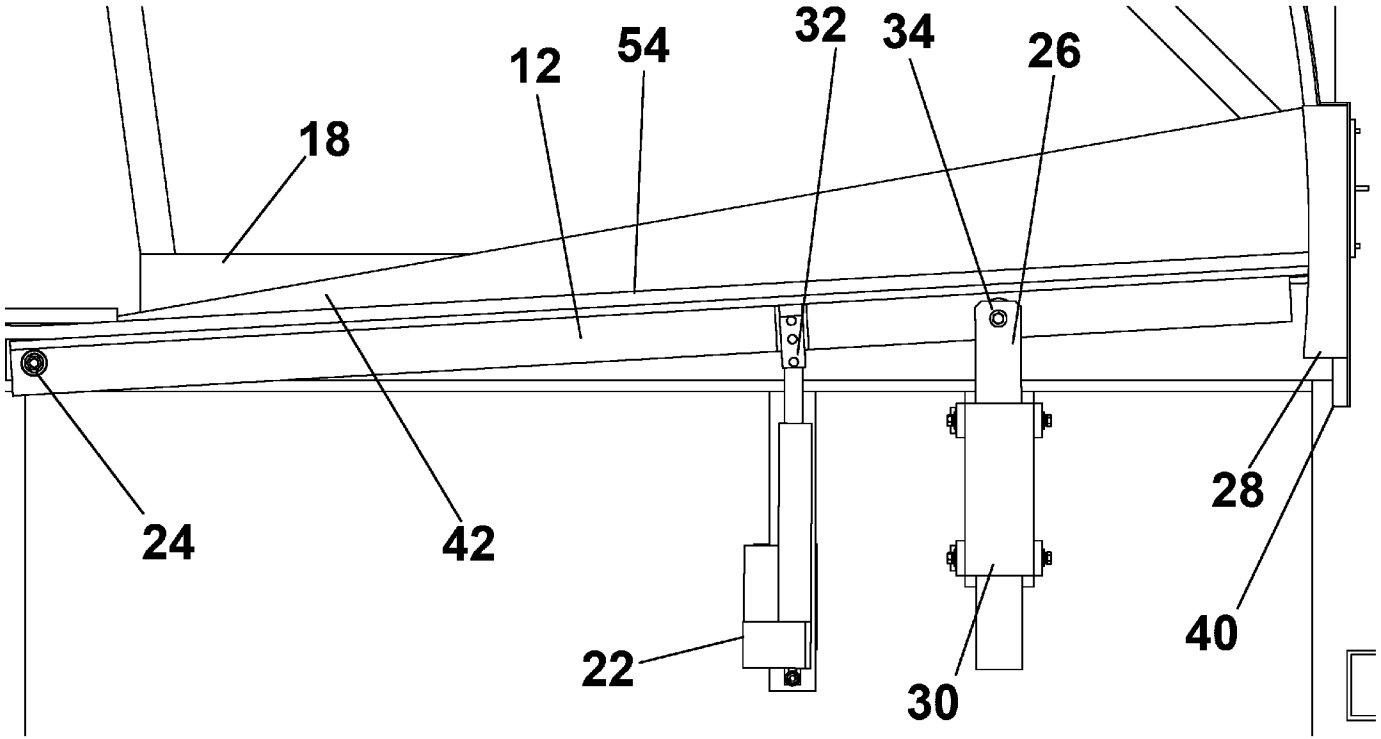
FIG. 19 depicts a graphic representation of the blade at 66% of maximum purge.

FIG. 19 shows the arrangement with angle $\theta=0.66\beta$, representing 66% of maximum purge.

Figure 20:
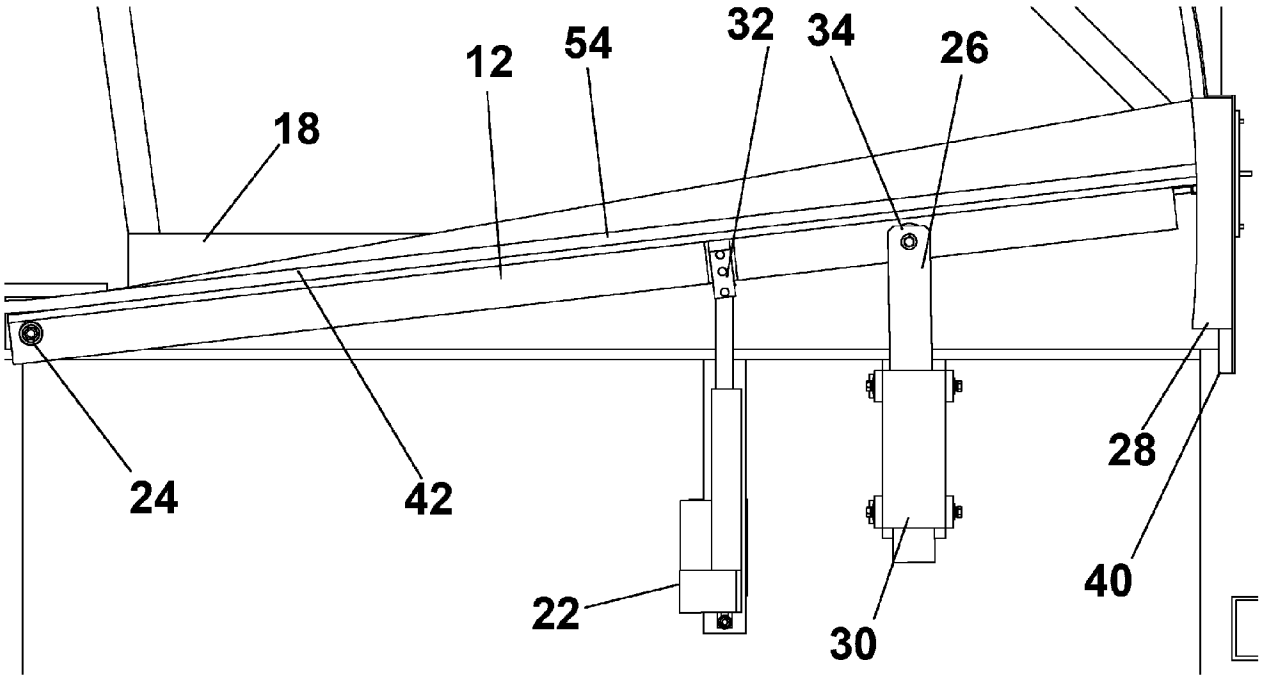
FIG. 20 depicts a graphic representation of the blade at 33% of maximum purge.

FIG. 20 shows the arrangement with angle $\theta=0.33\beta$, representing 33% of maximum purge.

Figure 21:
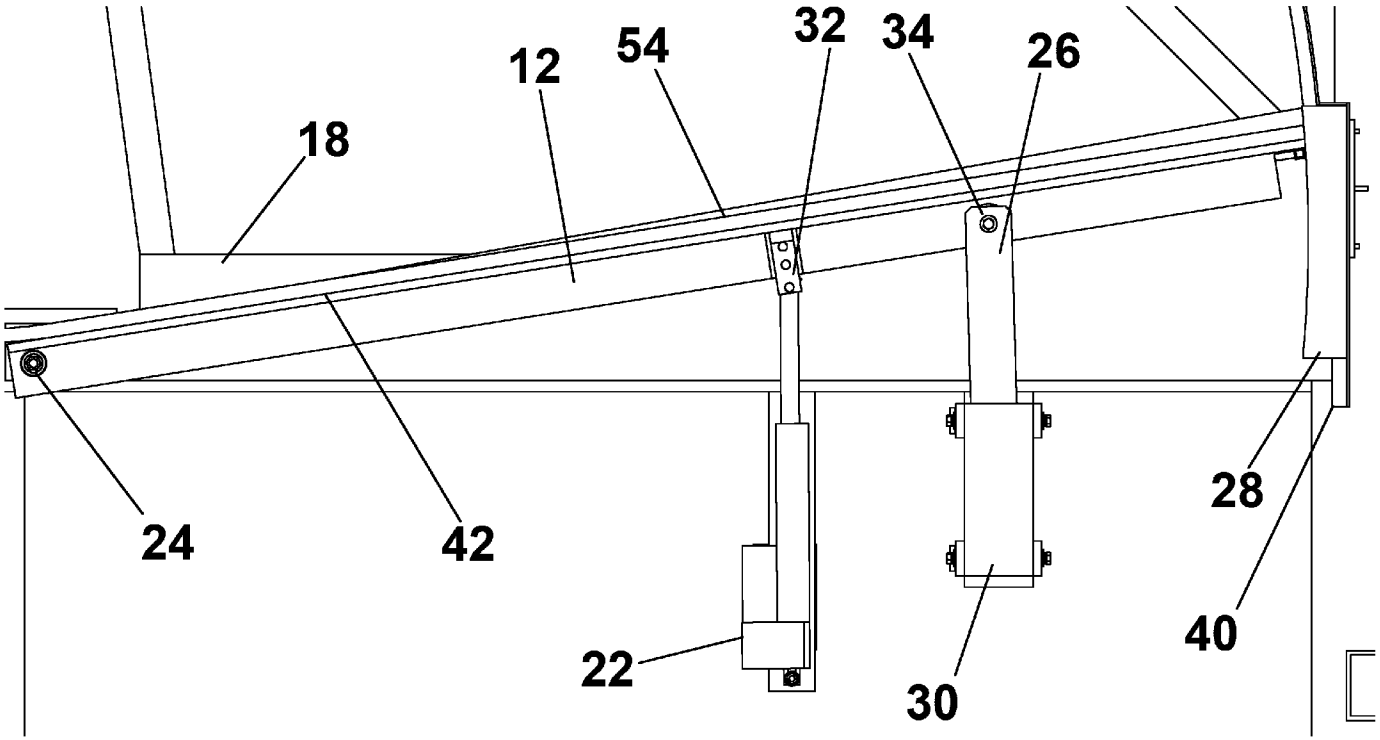
FIG. 21 depicts a graphic representation of the blade at 10% of maximum purge.

FIG. 21 shows the arrangement with angle $\theta=0.1\beta$, representing 10% of maximum purge. This position is an example of the position in which the purge is not allowed to further decrease, for safety reasons. This minimum position is defined by the control unit 16.

Figure 22:
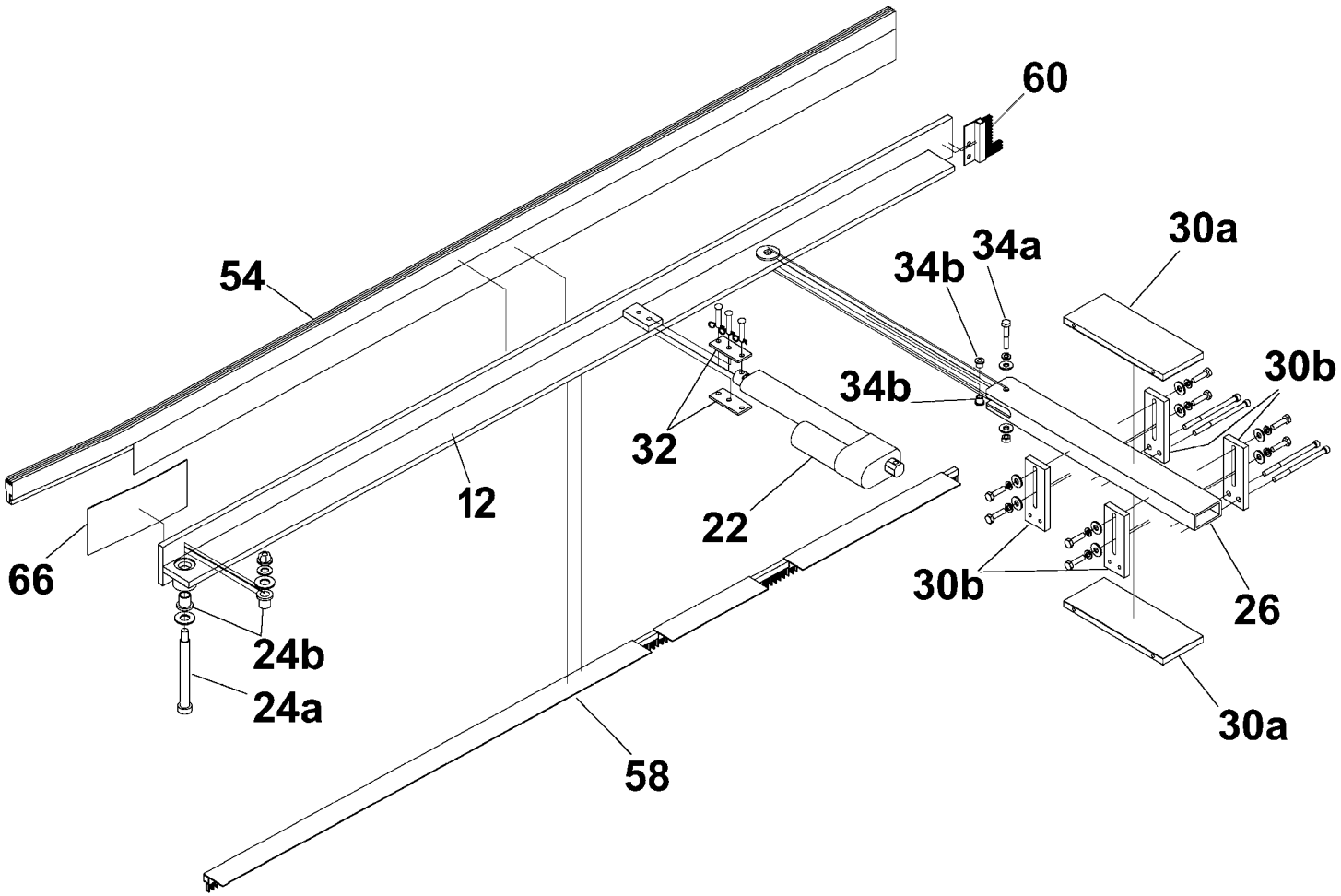
FIG. 22 is an exploded view of the wiper blade assembly depicted in FIG. 12, showing detail of the pin joint and connection of the actuator and torsional stiffener.

FIG. 22 shows an exploded view of the wiper blade 12 and the following appended parts and assemblies;

- pin joint or wiper blade axis of rotation 24
- actuator 22 and pin jointed interface for actuator 32
- stiffener arm 26, pin jointed interface for stiffener 34 and stiffener assembly 30
- dynamic radial seal 54, backplate seal 58, end seal brush 60, flexible seal 66.

Figure 23:
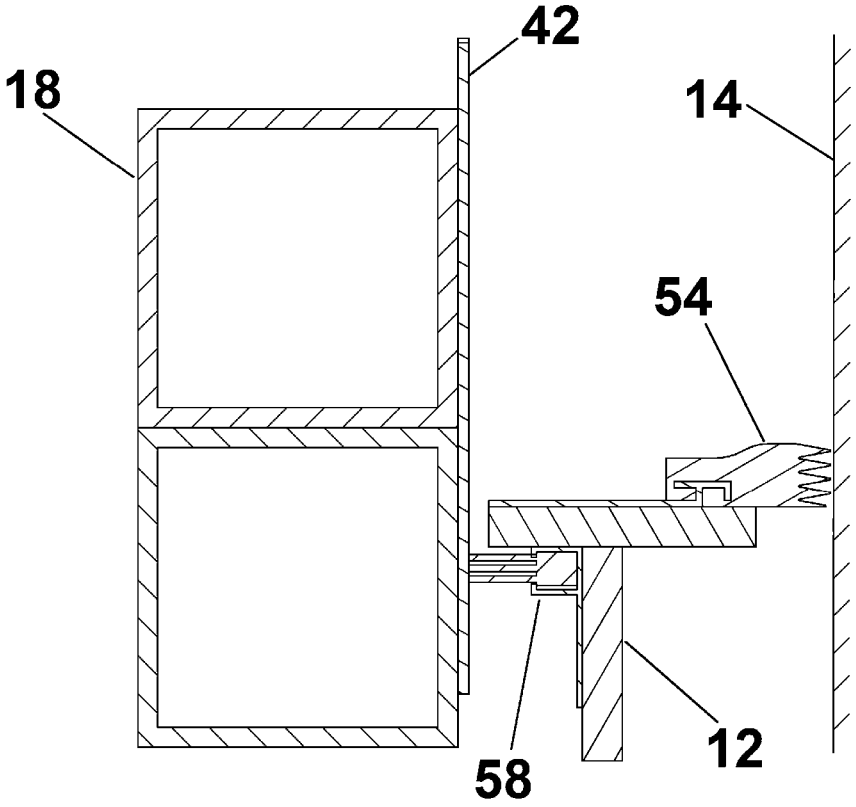
FIG. 23 is a sectional view of the wiper blade, showing casing structure, dynamic purge backplate, dynamic radial seal and backplate seal relative to the wheel.

FIG. 23 shows a cross section trough the wiper blade 12. It shows the relative positions of the casing structure 18, the flat backplate 42, backplate seal 58, wiper blade 12, dynamic radial seal 54 and wheel 14. The backplate seal 58 is a seal that maintains contact with the flat backplate 42 despite any undulations.

Control System

A control system 16 is used to operate the mechanical system. The control system detects changes in air flow conditions and provides the control signal to move the actuator 22 in or out, in turn moving the wiper blade 12 up or down to its intended position.

Figure 24:
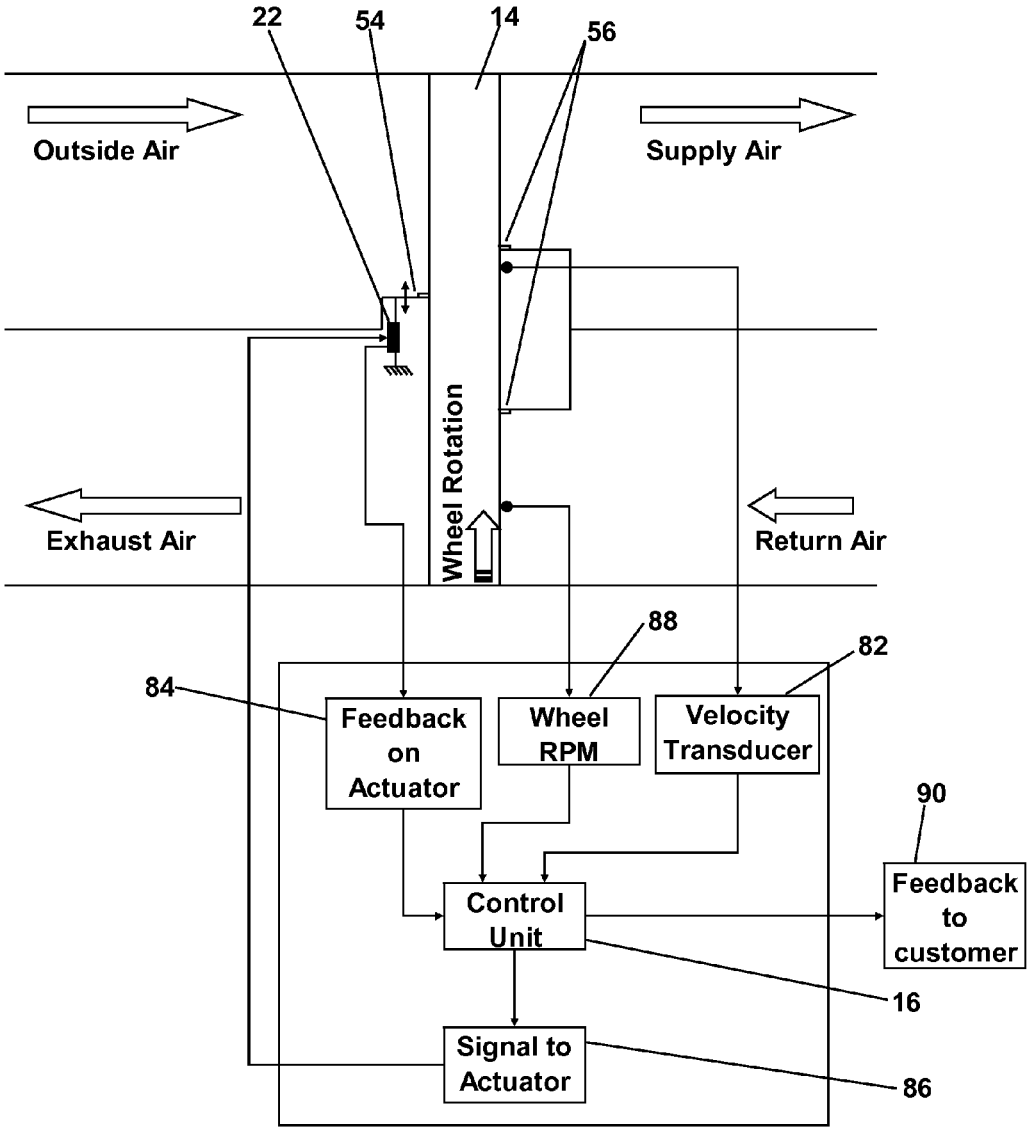
FIG. 24 is a schematic representation of the dynamic double purge, showing an example of the control system where an actuator position input and air velocity input are used.
Figure 25:
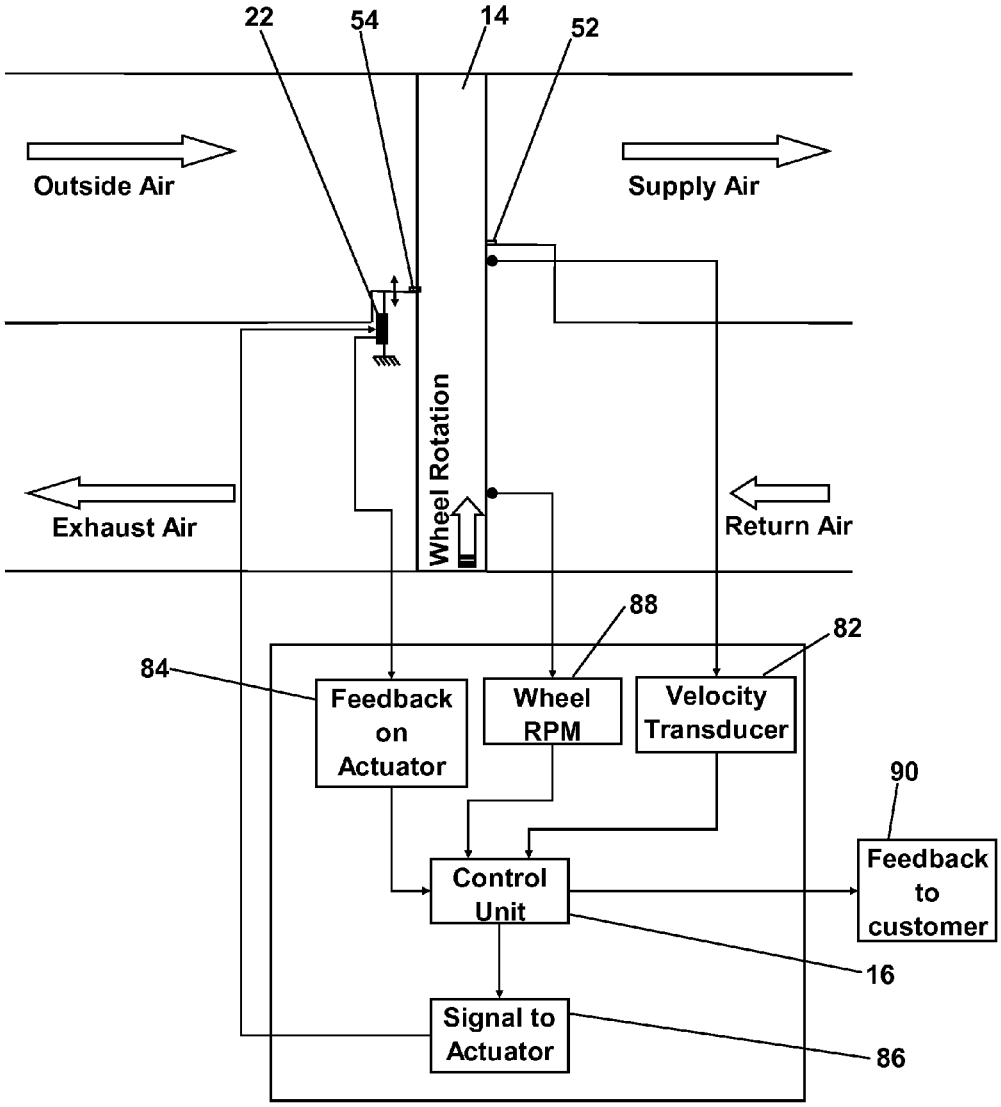
FIG. 25 is a schematic representation of the dynamic single purge, showing an example of the control system 16 where an actuator position input and air velocity input are used.

It is physically possible to measure air temperature, pressure or velocity and all may be used to identify the theoretically preferred purge angle. FIGS. 24-30 show examples of how this may be done for the double purge and single purge systems respectively. Measuring velocity in the purge system itself provides a preferred method of obtaining the optimum solution. One or more velocity sensors 82 are used to identify current air velocity through the purge section. FIG. 24 and FIG. 25 show examples where the velocity sensor(s) 82 measure the air velocity as it exits the wheel 14 on its first pass within the purge. The control unit 16 also receives inputs for current actuator position 84 and wheel rotational speed 88. The control unit 16 compares these data to enable its determination of preferred wiper blade 12 angle. It implements the preferred angle by providing output signal 86 to the actuator 22. Opportunity for providing the customer with information on performance is also available as an output 90.

Advantages of Discovery Over What was Done Before:

Compared to fixed purges—Fixed purges can only be optimized for one air flow condition. Although their purge angles can be adjusted for different flows, this requires human intervention and is impractical during normal operation. If the user runs the air conditioning fans at different powers over time, the heat wheel will not operate optimally. If the purge angle is set for 100% flow velocity, when the flow drops below this the purge will not operate fully and contaminants may get back into the supply air stream. If the purge angle is set for a value below 100%, then when the fans are running at 100% power, an excessive amount of air is being used in the purge, leading to energy inefficiency. The present invention overcomes these restrictions by maintaining the optimal purge angle under a range of conditions.

Compared to changing the rotational speed of the wheel—The aforementioned U.S. Patent Application Publication 2008/0108295 suggests changing the speed of the wheel to maintain a constant optimal purge angle. When the air speed reduces, so must the wheel rotational speed, in order to maintain sufficient time for the purge to operate fully. The reduced wheel speed results in reduced performance whereas the present invention maintains constant wheel speed, maintaining a higher effectiveness.

The present invention automatically responds to changing air flow conditions and uses an electromechanical actuator 22 to adjust the purge angle to its optimal position. The control system 16 senses velocity in the purge using velocity sensor 82. The wiper blade 12 is pin jointed 24 and rotates about a different axis to the wheel 14. To maintain constant seals an "Undercut Seal" 28 is used to enable the wiper blade 12 to maintain close proximity. A torsional stiffener sub-assembly 30 is used to maintain perpendicular and angular position to the wheel 14, that is, this assembly serves as means for maintaining a planar motion of the wiper blade 12. This comprises a stiffener arm 26 that moves between slides 30*a*, which constrain it to planar movement only.

Maintenance and Accessibility:

The invention is designed so that it can be removed from the heat recovery wheel unit without removing any parts of the wheel. Components that require maintenance or, perhaps, replacement are fixed using removable fasteners with preplanned removal paths.

Alternative Methods of Parameter Measurements:

An alternative to measuring air velocity is to measure one of the following:

Temperature—this is already measured in systems where the wheel has a speed control system. It is possible to measure temperature gradient across the purge to monitor completeness of operation.

Pressure—Pressure is the driver for airflow in the whole air conditioning system. A drop in air flow conditions is caused by a drop in driving pressure, which affects the downstream pressures. Pressure differences across the purge can be measured to indicate the expected through velocity as a function of media geometry.

Figure 26:
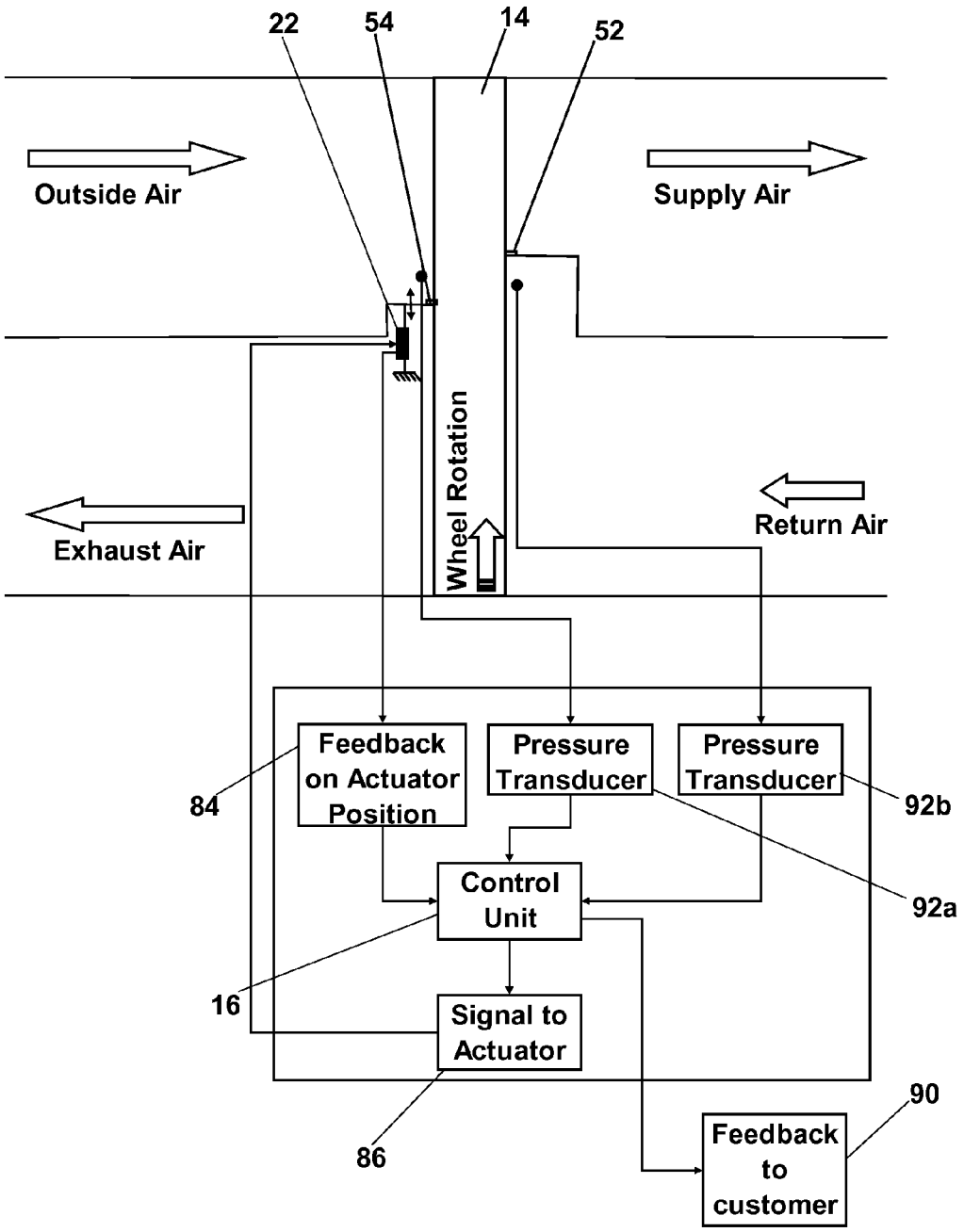
FIG. 26 is a schematic representation of the dynamic single purge, showing an example of the control system 16 where an actuator position input and air pressure inputs are used.

Alternatives to Control System:

FIG. 26 shows an additional example for the single purge arrangement where pressure is measured in two locations using pressure transducers 92*a*,92*b*. The first location 92*a* is where the air enters the wheel before passing through the purge and the second location 92*b* is where the air exits the wheel after passing through the purge. These measurements are used to calculate purge air flow. The position of the actuator is identified using actuator feedback 84.

Figure 27:
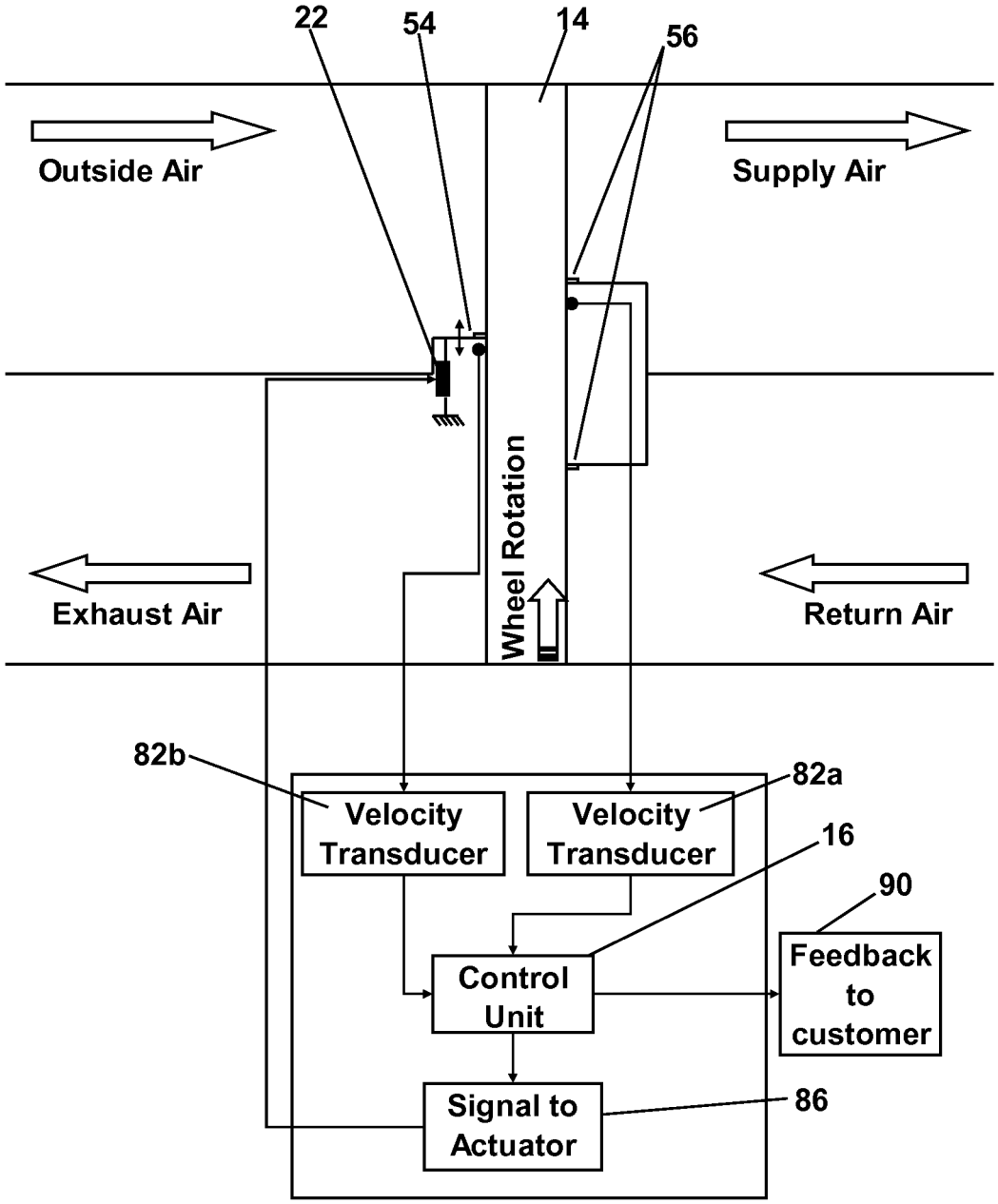
FIG. 27 is a schematic representation of the dynamic double purge, showing an example of the control system where air velocity inputs are used exclusively.

FIG. 27 shows an additional example for the double purge arrangement, where air velocity is measured in two locations using velocity sensors 82*a*,82*b*. The first location 82*a* is where the air exits the wheel 14 after the first pass through the purge and the second location 82*b* is where the air exits the wheel 14 after the second pass through the purge. As the wiper blade 12 moves the relative areas of the first and second stages of the purge also change. This results in a difference in air velocity which is used to inform the control system of the current purge angle, in addition to current air flow conditions.

Figure 28:
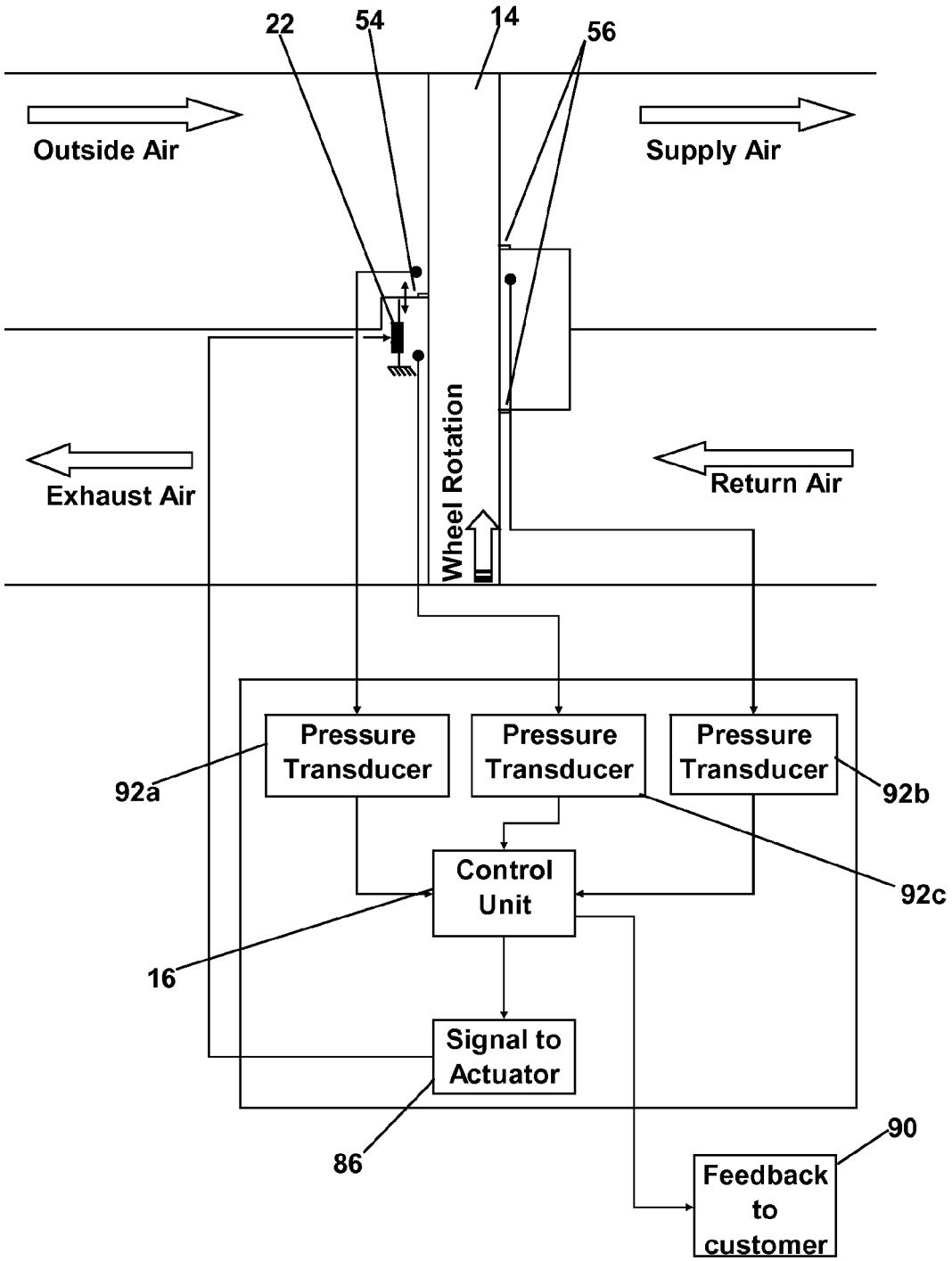
FIG. 28 is a schematic representation of the dynamic double purge, showing an example of the control system where pressure are used exclusively.

FIG. 28 further shows this same process, now using pressure transducers 92*a*, 92*b*, 92*c*. The principle is the same, whereby the pressure difference across the two stages of the purge is defined by 92*a* and 92*b* and by 92*b* and 92*c* respectively. These differential pressures are directly related to air velocity.

The three alternative examples described above use the same principle as the suggested process: Various input signals 82, 84, 92 inform the control unit of current wiper blade 12 position and current air velocity through the purge. The controller compares these to determine preferred wiper blade position. Wheel rotational speed is not included in these examples but can be if improved performance is desired. The same can be said for the following examples.

Figure 29:
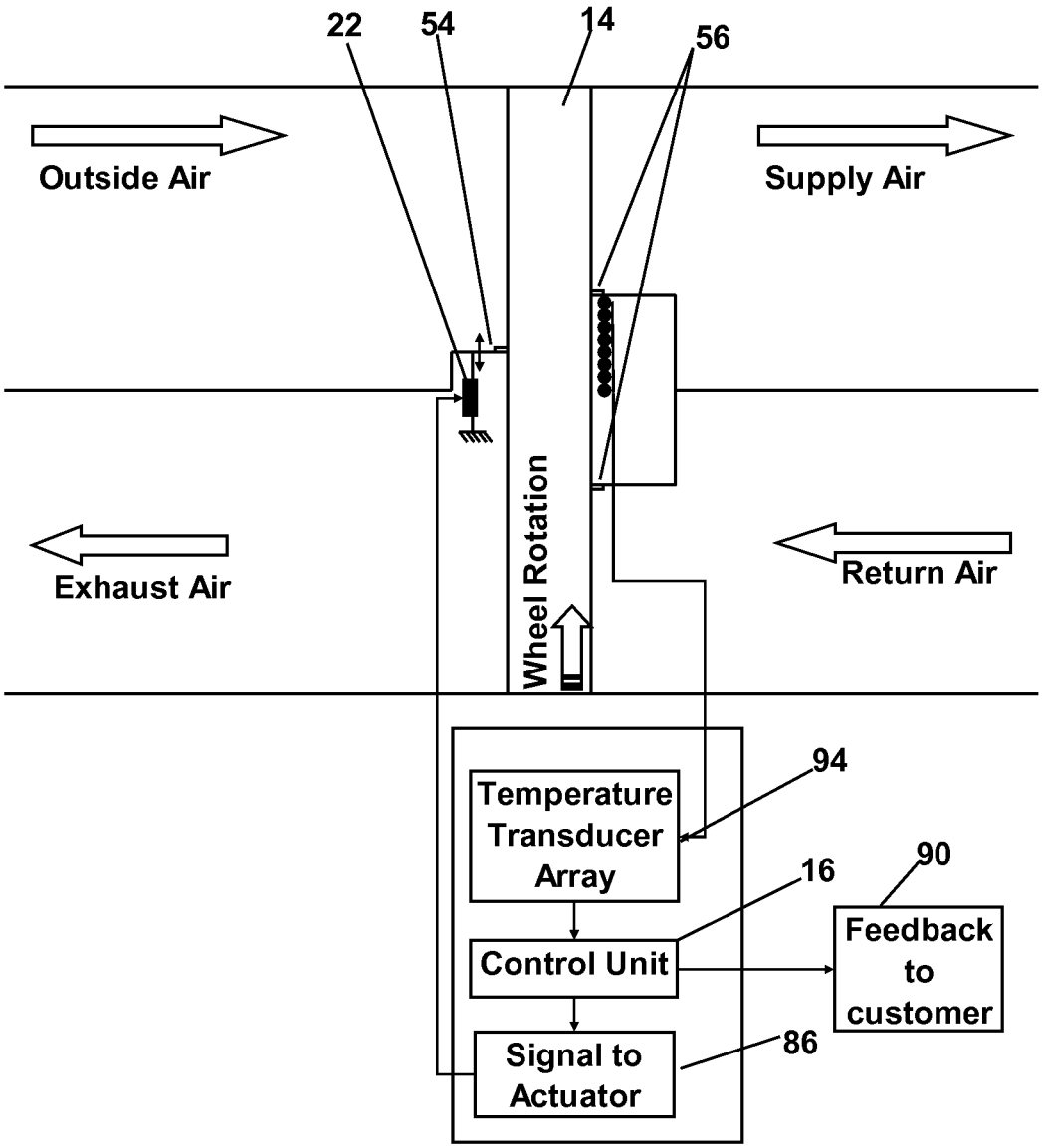
FIG. 29 is a schematic representation of the dynamic double purge, showing an example of the control system where an array of temperature sensors are used as inputs.
Figure 30:
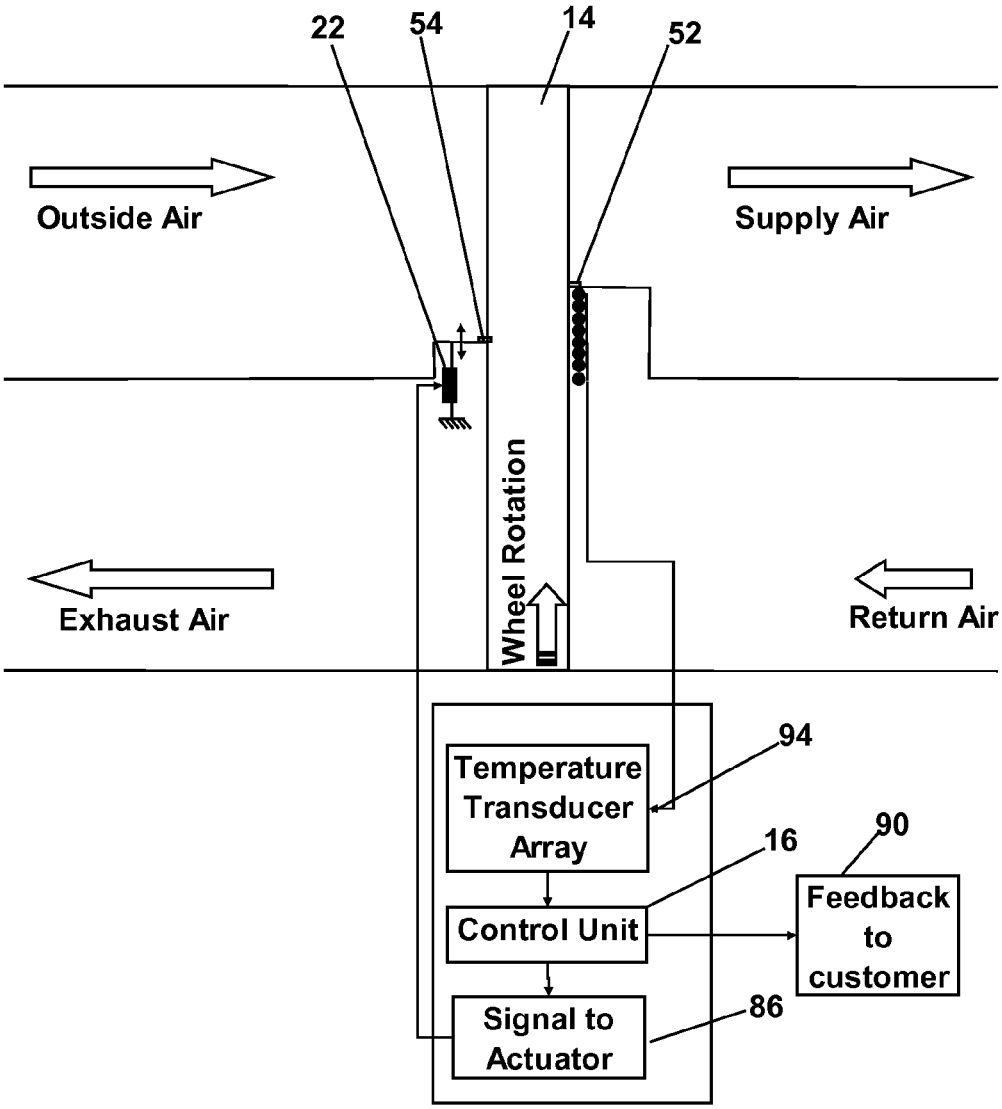
FIG. 30 is a schematic representation of the dynamic single purge, showing an example of the control system where an array of temperature sensors are used as inputs.

The control systems shown in FIGS. 29 and 30 depart from the above process. In these examples, the temperature across the purge is measured by an array of transducers 94. This means of measurement can be used where a safety margin is imposed on the system. If the purge angle is slightly oversized (therefore providing a safety margin) a temperature gradient will be observed at the point where the air flow in the purge changes from a mixture of supply and exhaust gases, to 100% supply air. The array of temperature sensors 94 detects the location of this change by detecting variation in temperature and informs the control system 16 of current safety margin. The control system then adjusts the wiper blade position, by providing a signal 86 to the actuator 22, so the safety margin and purge performance are optimized.

Why was this not done before?

Although purge systems are well established in the heat wheel industry, a dynamic purge has not been developed. The following reasons are suggested:

Seals—To maintain high performance, the seals that separate air flows must maintain very close proximity to the moving wheel. A dynamic system increases the risk of this gap widening or, worse still, the moving seal moving towards the wheel and causing damage to the light, fluted structure.

Limited space—The envelope in which an electromechanical system can be fitted is very limited. Outside the case there is structure and flashing. Within the case there are only a few inches between the case structure and the wheel. An innovative approach was required to generate a compact solution.

The industry has not previously recognized sufficient need to maintain maximum purge performance under all air conditioning flow situations. In combination with the technical challenges described above this has made competitors unwilling to develop novel solutions.

The invention enables safe and effective use of heat wheels in environments where it is essential that contaminants are not passed into the supply air. Purge systems are well established in the industry with proven results. These can provide safe use of heat wheels but are not optimized for changing air flow conditions. What is not present in the industry is a purge that can change its own purge angle in accordance with changing air flow conditions. The aerodynamics behind purge operation is the same, but the ability to alter angle dynamically enables optimized performance.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. An automatic operable, dynamic purge system for a heat recovery wheel comprising:

a heat recovery wheel assembly having one or two fixed radial seals and a dynamically movable radial seal, said one or two fixed radial seals and said dynamically movable radial seal being configured for directing a controlled supply of air into an exhaust air stream passing through a heat recovery wheel of said assembly, wherein said one or two radial fixed seals are on one face of said heat recovery wheel and said dynamically movable radial seal and is located on an opposite face of said heat wheel recovery;

wherein when said heat recovery wheel includes said one fixed radial seal and said dynamically movable radial seal, said fixed and dynamic seals are located to create a single purge so that purged air travels through said wheel once, and wherein when said heat recovery wheel includes said two fixed radial seals and said dynamically movable radial seal, said fixed and dynamic radial seals are located to create a double purge so that purged air travels through said wheel twice, said dynamically movable radial seal being secured by an automatically operable rotatable wiper blade, wherein as said wiper blade rotates, said dynamically movable radial seal rotates while remaining approximately radial to said heat recovery wheel.

2. The system according to claim 1, further comprising:

means for altering an effective angle of said single or double purge by moving said wiper blade to a desired optimal position based on time varying air flow conditions and predetermined input data calculated by a control system.

3. The system according to claim 2, wherein said means for altering said effective angle of said single or double purge by moving said wiper blade to said desired optimal position based on said predetermined input data comprises actuator means in mechanical communication with said wiper blade.

4. The system according to claim 2, wherein said predetermined input data includes one of or any combination of:

data related to an air velocity at an exit side of a first pass through a purge section;

data related to first air velocity at said exit side of said first pass through said purge section and data related to a second air velocity at a second exit of a second pass through said purge section;

data related to a first air pressure at said exit side of said first pass through said purge section, and data related to a second air pressure at an entry side before a supply air enters said purge section;

data related to a first air pressure at said exit side of said first pass through said purge section, data related to a second air pressure at a second exit of a second pass through said purge section and data related to a third air pressure at an entry side before a supply air enters said purge section; and data related to temperature at an exit side of a first pass through said purge section.

5. The system according to claim 1, further comprising:

means for maintaining a planar motion of said wiper blade.

6. A method for directing a controlled supply of air into an exhaust air stream passing through a heat recovery wheel of a heat recovery wheel assembly, the method comprising:

providing a heat recovery wheel assembly having one or two fixed radial seals and a dynamically movable radial seal, said one or two fixed radial seals and said dynamically movable radial seal being configured for directing a controlled supply of air into an exhaust air stream passing through a heat recovery wheel of said assembly, wherein said one or two fixed seals are on one face of said heat recovery wheel and said dynamically movable radial seal and is located on an opposite face of said heat recovery wheel, wherein when said heat recovery wheel includes said one fixed radial seal and said dynamically movable radial seal, said fixed and dynamic seals are located to create a single purge so that purged air travels through said wheel once, and wherein when said heat recovery wheel includes said two fixed radial seals and said dynamically movable radial seal, said fixed and dynamic seals are located to create a double purge so that purged air travels through said wheel twice, wherein said dynamically movable radial seal is secured by a rotatable wiper blade, wherein as said wiper blade rotates, said dynamically movable radial seal rotates while remaining approximately radial to said heat recovery wheel;

providing means for altering an effective angle of said single or double purge by automatically moving said wiper blade to a desired optimal position based on time varying air flow conditions and predetermined input data calculated by a control system; and directing a controlled supply of air into an exhaust air stream passing through said heat recovery wheel of said heat recovery wheel assembly by moving said wiper blade to said desired optimal position based on said predetermined input data calculated by said control system, wherein said predetermined input data includes one of or any combination of:

data related to an air velocity at an exit side of a first passthrough a purge section;

data related to first air velocity at said exit side of first pass through said purge section and data related to a second air velocity at a second exit of a second pass through said purge section;

data related to a first air pressure at said exit side of said first pass through said purge section, and data related to a second air pressure at an entry side before a supply air enters said purge section;

data related to a first air pressure at said exit side of said first pass through said purge section, data related to a second air pressure at a second exit of a second pass through said purge section and data related to a third air pressure at an entry side before a supply air enters said purge section; and data related to temperature at an exit side of a first pass through said purge section.

7. The method according to claim 6, wherein said means for altering said effective angle of said single or double purge by moving said wiper blade to said desired optimal position based on said predetermined input data comprises actuator means in mechanical communication with said wiper blade.

8. The method according to claim 6, further comprising:

providing means for maintaining a planar motion of said wiper blade.

* * * * *